US012575641B2

(12) United States Patent
Hann

(10) Patent No.: US 12,575,641 B2
(45) Date of Patent: Mar. 17, 2026

(54) SHOE

(71) Applicant: HANN ATHLETIC, LLC, Valparaiso, IN (US)

(72) Inventor: Lenn R. Hann, Valparaiso, IN (US)

(73) Assignee: Hann Athletic, LLC, Valparaiso, IN (US)

( * ) Notice: Subject to any disclaimer, the term of this patent is extended or adjusted under 35 U.S.C. 154(b) by 390 days.

(21) Appl. No.: 17/581,456

(22) Filed: Jan. 21, 2022

(65) Prior Publication Data

US 2022/0232929 A1 Jul. 28, 2022

Related U.S. Application Data

(60) Provisional application No. 63/140,613, filed on Jan. 22, 2021.

(51) Int. Cl.
*A43B 13/18* (2006.01)
*A43B 13/12* (2006.01)

(52) U.S. Cl.
CPC ..... *A43B 13/188* (2013.01); *A43B 13/122* (2013.01); *A43B 13/125* (2013.01)

(58) Field of Classification Search
CPC ... A43B 13/188; A43B 13/122; A43B 13/125; A43B 13/183; A43B 13/185; A43B 13/186; A43B 13/026
See application file for complete search history.

(56) References Cited

U.S. PATENT DOCUMENTS

| | | | |
|---|---|---|---|
| 75,900 | A | 3/1868 | Hale et al. |
| 224,937 | A | 2/1880 | Mintzer |
| 291,490 | A | 1/1884 | Buch |
| 324,065 | A | 8/1885 | Andrews |
| 357,062 | A | 2/1887 | Buch |
| 413,693 | A | 10/1889 | Walker |
| 427,136 | A | 5/1890 | Walker |
| 766,101 | A | 7/1904 | Croner |
| 871,864 | A | 11/1907 | Feazell et al. |

(Continued)

FOREIGN PATENT DOCUMENTS

WO WO2007113595 A2 10/2007

OTHER PUBLICATIONS

ISA/US, English language verison of the International Search Report, Form PCT/ISA/210, for International Application PCT/US22/13451, Jan. 24, 2022 (4 pages).

(Continued)

*Primary Examiner* — Haley A Smith

(74) *Attorney, Agent, or Firm* — Christensen O'Connor Johnson Kindness PLLC

(57) ABSTRACT

A shoe includes an upper and a sole each with a forward region with a forward center of loading and a rear region with a rear center of loading. The sole includes an insole, a midsole, and an outsole. Two integrated suspension elements include an upper suspension arm and a lower suspension arm that are joined at respective ends. The integrated suspension elements are disposed between at least a portion of the midsole and the outsole. The integrated suspension elements each have a center of compression generally aligned with the forward center of loading and the rear center of loading. The integrated suspension elements extend substantially laterally across a width of the midsole and the outsole.

30 Claims, 27 Drawing Sheets

(56) References Cited

U.S. PATENT DOCUMENTS 1,088,328 A 2/1914 Cucinotta
1,352,865 A 9/1920 Augestad
1,469,920 A 10/1923 Dutchak
1,471,966 A 10/1923 Light
1,587,749 A 6/1926 Bierly
1,625,048 A 4/1927 Nock
1,638,350 A 8/1927 Long
1,726,028 A 8/1929 Keller
1,929,126 A 10/1933 Tuki et al.
1,942,312 A 1/1934 Tutoky
2,172,000 A 9/1939 Wenker
2,399,543 A 4/1946 Dack
2,413,545 A 12/1946 Cordi
2,447,603 A 8/1948 Snyder
2,814,132 A 11/1957 Montoscuro
2,953,861 A 9/1960 Horten
3,886,674 A 6/1975 Pavia
4,241,523 A 12/1980 Daswick
4,309,832 A 1/1982 Hunt
4,342,158 A 8/1982 McMahon et al.
4,457,084 A 7/1984 Horibata et al.
4,492,046 A 1/1985 Kosova
4,492,374 A 1/1985 Lekhtman et al.
4,534,124 A 8/1985 Schnell
4,566,206 A 1/1986 Weber
4,592,153 A 6/1986 Jacinto
4,638,575 A 1/1987 Illustrato
4,843,737 A 7/1989 Vorderer
4,881,329 A 11/1989 Crowley
4,910,884 A * 3/1990 Lindh ..... A43B 13/18 36/27
5,005,300 A 4/1991 Diaz et al.
5,060,401 A 10/1991 Whatley
5,138,776 A 8/1992 Levin
5,279,051 A 1/1994 Whatley
5,282,325 A 2/1994 Beyl
5,343,636 A 9/1994 Sabol
5,353,523 A 10/1994 Kilgore et al.
5,367,790 A 11/1994 Gamow et al.
5,381,608 A 1/1995 Claveria
5,396,718 A 3/1995 Schuler et al.
5,435,079 A 7/1995 Gallegos
5,461,800 A 10/1995 Luthi et al.
5,477,626 A 12/1995 Kwon
5,513,448 A 5/1996 Lyons
5,577,334 A 11/1996 Park
5,706,589 A 1/1998 Marc
5,729,916 A 3/1998 Vorobiev et al.
5,822,886 A 10/1998 Luthi et al.
5,875,567 A 3/1999 Bayley
5,896,679 A 4/1999 Baldwin
5,916,071 A 6/1999 Lee
5,940,994 A 8/1999 Allen
6,006,449 A 12/1999 Orlowski et al.
6,029,374 A 2/2000 Herr et al.
6,065,230 A 5/2000 James
6,079,126 A 6/2000 Olszewski
6,115,943 A * 9/2000 Gyr ..... A43B 21/26 36/35 R
6,282,814 B1 9/2001 Krafsur et al.
6,338,207 B1 * 1/2002 Chang ..... A43B 13/203 36/35 B
6,393,731 B1 5/2002 Moua et al.
6,449,878 B1 9/2002 Lyden
6,457,261 B1 10/2002 Crary
6,601,042 B1 7/2003 Lyden
6,769,202 B1 8/2004 Luthi et al.
6,796,056 B2 9/2004 Swigart
7,334,351 B2 * 2/2008 Hann ..... A43B 13/16 36/102
7,788,824 B2 * 9/2010 Hann ..... A43B 13/141 36/102
2002/0047040 A1 4/2002 Andrews, Sr. et al.
2002/0174567 A1 11/2002 Krafsur et al.
2003/0208929 A1 * 11/2003 Lucas ..... A43B 3/0063 36/27
2004/0068892 A1 4/2004 Wang
2005/0268488 A1 * 12/2005 Hann ..... A43B 13/16 36/27
2006/0064900 A1 3/2006 Aveni
2007/0271818 A1 * 11/2007 Rabushka ..... A43B 13/187 36/38
2014/0349818 A1 * 11/2014 Green ..... A63C 17/065 482/77
2018/0213886 A1 8/2018 Connell et al.
2019/0200699 A1 * 7/2019 Ghiotti ..... A43B 17/006
2019/0216169 A1 * 7/2019 Yahata ..... A43B 13/146
2019/0320759 A1 * 10/2019 Conrad ..... A43B 13/186
2021/0015209 A1 * 1/2021 Buck ..... A43B 13/184
2021/0037914 A1 * 2/2021 Adametz ..... A43B 13/185

OTHER PUBLICATIONS

ISA/US, Form PCT/ISA/237, Written Opinion of the International Searching Authority, for International Application PCT/US22/13451, Jan. 24, 2022 (13 pages).

* cited by examiner

SHOE

CROSS REFERENCE TO RELATED APPLICATION(S)

This application claims the benefit of U.S. Provisional Application Ser. No. 63/140,613, filed on 22 Jan. 2021. The co-pending provisional application is hereby incorporated by reference herein in its entirety and is made a part hereof, including but not limited to those portions which specifically appear hereinafter.

BACKGROUND OF THE INVENTION

Field of the Invention

This invention relates generally to a shoe that includes one or more suspension elements.

Description of Prior Art

Shoes traditionally include an upper that receives a foot of a wearer (also represented by a last) and a sole connected to the upper. The sole generally includes an insole underneath the foot/last, as well as a midsole and/or an outsole that form a bottom portion of the shoe.

When a wearer walks or runs within a shoe, the load of the wearer's body is exerted on a heel portion of the shoe with a downward force from the heel of the wearer. The downward force is exerted from a center of the wearer's heel through a center of the heel portion of the shoe, or a rear center of loading. As the wearer progresses through the movement, the load of the wearer's body is transferred, and exerted on a forefoot portion of the shoe with a downward force from the ball of the foot of the wearer. The downward force is exerted from a center of the wearer's ball of the foot through a center of the forefoot portion of the shoe, or a forward center of loading.

Using shoes for an extended period of time can cause fatigue to the wearer as the shoe materials break down from the downward force of the wearer's body weight and force applied to the shoe components. The resulting fatigue can include fatigue to the muscles, tendons, ligaments, and/or cartilage of not only the feet and legs of the wearer, but also the torso and other parts of the body.

To reduce or eliminate fatigue to the wearer's body, as well as improve longevity and integrity of shoes, various improvements have been made to shoe components to reduce impact forces from a change in loading when a wearer uses a shoe, or to reduce "bottoming out" of conventional shoe materials. Once such improvement is shown in U.S. Pat. No. 7,334,351 ("the '351 patent"), which is incorporated herein by reference. The '351 patent provides a shoe with a suspension element to improve efficiency of the shoe and reduce neuromuscular fatigue.

The present invention provides a shoe preferably with two suspension elements that improve performance over existing shoes, such as over the shoes described in the '351 patent. The subject shoe preferably includes carbon fiber suspension element(s) with a mechanical midsole that is more efficient in whole body systemic oxygen consumption than conventional foam midsole shoes. The subject suspension element(s) efficiently compress and improve timing of heel-to-toe energy transfer when a wearer uses a shoe to walk or run, particularly in an athletic shoe.

SUMMARY OF THE INVENTION

The present invention provides a shoe that includes an upper and a sole. The upper and the sole each include a forward region with a forward center of loading and a rear region with a rear center of loading.

The sole generally includes an insole, a midsole, an outsole and two integrated suspension elements. The integrated suspension elements each preferably include an upper suspension arm and a lower suspension arm that are joined at respective ends. The integrated suspension elements are disposed between at least a portion of the midsole and the outsole. The integrated suspension elements each have a center of compression. Each center of compression is generally aligned with the forward center of loading and the rear center of loading, respectively. The integrated suspension elements extend substantially laterally across a width of the midsole and the outsole. The midsole and the outsole include a plurality of layers and material adjacent to the integrated suspension elements.

The two integrated suspension elements preferably include a forefoot suspension element and a heel suspension element. The forefoot suspension element preferably includes a length that is greater than a length of the heel suspension element; and the heel suspension element preferably includes a height that is greater than a height of the forefoot suspension element.

The material of the midsole surrounds at least a portion of the upper suspension arm. The material of the outsole surrounds at least a portion of the lower suspension arm. At least one integrated suspension element includes two intersecting arcs defined by the upper suspension arm and the lower suspension arm forming a mandorla, defining a hollow suspension region therebetween. At least one integrated suspension element also preferably includes a joint that joins the upper suspension arm and the lower suspension arm at respective ends of the upper suspension arm and the lower suspension arm. The joint may include at least one elastomer, polymer, or mechanical hinge. At least one integrated suspension element may include a carbon suspension core. The carbon suspension core includes variably-arranged polypropylene fibers.

The two integrated suspension elements of the shoe may include a forward integrated suspension element disposed below the forward region of the upper and the sole, and a rear integrated suspension element disposed below the rear region of the upper and the sole. Each of the forward integrated suspension element and the rear integrated suspension element include a hollow, mandorla-shape defined by the upper suspension arm and the lower suspension arm joined by at least one joint configured to join the upper suspension arm and the lower suspension arm at respective ends of the upper suspension arm and the lower suspension arm.

The forward integrated suspension element includes a center of compression generally aligned with the forward center of loading. The midsole of the shoe includes an openable cavity extending a lateral width of the forward integrated suspension element disposed between a portion of the midsole and a portion of the upper suspension arm of the forward integrated suspension element. The openable cavity extends longitudinally from an end of the upper suspension arm of the forward integrated suspension element, to another point along a length of the upper suspension arm. The midsole also includes a fabric border extending along a perimeter of the openable cavity. The fabric border abuts a portion of midsole and the upper suspension arm of the forward integrated suspension element.

The rear integrated suspension element includes a center of compression generally aligned with the rear center of loading. The rear integrated suspension element preferably includes a compressible layer disposed between a portion of the outsole and the lower suspension arm of the rear integrated suspension element. The compressible layer extends along a length of the lower suspension arm.

The sole of the shoe preferably includes at least one cavity disposed across a portion of a lateral width of the rear integrated suspension element disposed between a portion of the sole and a portion of the upper suspension arm of the rear integrated suspension element. The sole may include a plurality of cavities disposed generally equidistant across the lateral width of the midsole disposed between a portion of the sole and a portion of the upper suspension arm of the rear integrated suspension element.

Another object of the invention can be attained, at least in part, through a shoe including an upper with a forward region with a forward center of loading and a rear region with a rear center of loading, an insole, and a midsole that includes at least one convex suspension arm integrated with a portion of the midsole. The at least one convex suspension arm includes a composite material having a greater resistance than the plurality of layers and materials of the midsole.

According to one embodiment, the shoe also includes an outsole with at least one concave suspension arm integrated with a portion of the outsole. The at least one concave suspension arm has a composite material having a greater resistance than the plurality of layers and materials of the outsole. A first end of the at least one convex suspension arm is joined with a first end of the at least one concave suspension arm, and a second end of the at least one convex suspension arm is joined with a second end of the at least one concave suspension arm. The at least one convex suspension arm and the at least one concave suspension arm are configured to form a mandorla-shaped suspension element integrated between the midsole and the outsole. At least one joint element secures the first and second ends of the at least one convex suspension arm with the first and second ends of the at least one concave suspension arm.

The at least one joint may include an elastomer disposed therebetween at least one pair of the first ends and the second ends. The at least one joint may also include a bead of silicone disposed adjacent to an overlap of at least one pair of the first ends and the second ends. The at least one joint may further or alternatively include a polymer hinge with a first insert and a second insert. The first end or the second end of the at least one convex suspension arm plugs into the first insert, and the first end or the second end of the at least one concave suspension arm plugs into the second insert. The at least one joint may also include an elastomer hinge where the first end or the second end of the at least one convex suspension arm can plug into a portion of the elastomer hinge, and where the first end or the second end of the at least one concave suspension arm can plug into another portion of the elastomer hinge.

The at least one concave suspension arm may include a suspension bumper aligned with the center of compression. The suspension bumper protrudes into a hollow interior of the mandorla-shaped suspension element. The mandorla-shaped suspension element may include a suspension booster in a hollow interior of the mandorla-shaped suspension element aligned with the center of compression. The suspension booster is operatively attached to a portion of the at least one convex suspension arm and extends to a portion of the at least one concave suspension arm. The mandorla-shaped suspension element may further include a retaining rod extending laterally across at least one of the convex suspension arm and the concave suspension arm, and a plurality of links to connect to the retaining rod through the center of compression and protrude into a hollow interior of the mandorla-shaped suspension element.

Yet another object of the subject invention can be attained by a shoe with an upper including a forward region with a forward center of loading and a rear region with a rear center of loading, an insole including a high density sock layer, a midsole including a plurality of layers and materials, and an outsole including rubber.

The shoe also includes a first mandorla-shaped suspension element with an upper suspension arm and a lower suspension arm. The shoe further includes a second mandorla-shaped suspension element with an upper suspension arm and a lower suspension arm. The outsole of the shoe may include a two-piece outsole, where a portion of the two-piece outsole is removable, and where the second mandorla-shaped suspension element is replaceable with another mandorla-shaped suspension element.

Other objects and advantages will be apparent to those skilled in the art from the following detailed description taken in conjunction with the claims and drawings.

DETAILED DESCRIPTION OF THE INVENTION

The present invention provides a shoe having a pair of improved integrated suspension elements. The shoe of the subject invention improves lateral (torsional) stability in carbon fiber composite elliptical suspension elements. At least one previous shoe design uses generally longitudinal fiber to create a suspension effect, but said suspension effect causes shoes to roll excessively, to varying degrees. The present invention is directed to a shoe having a substantially higher degree of lateral stability.

Figure 1:
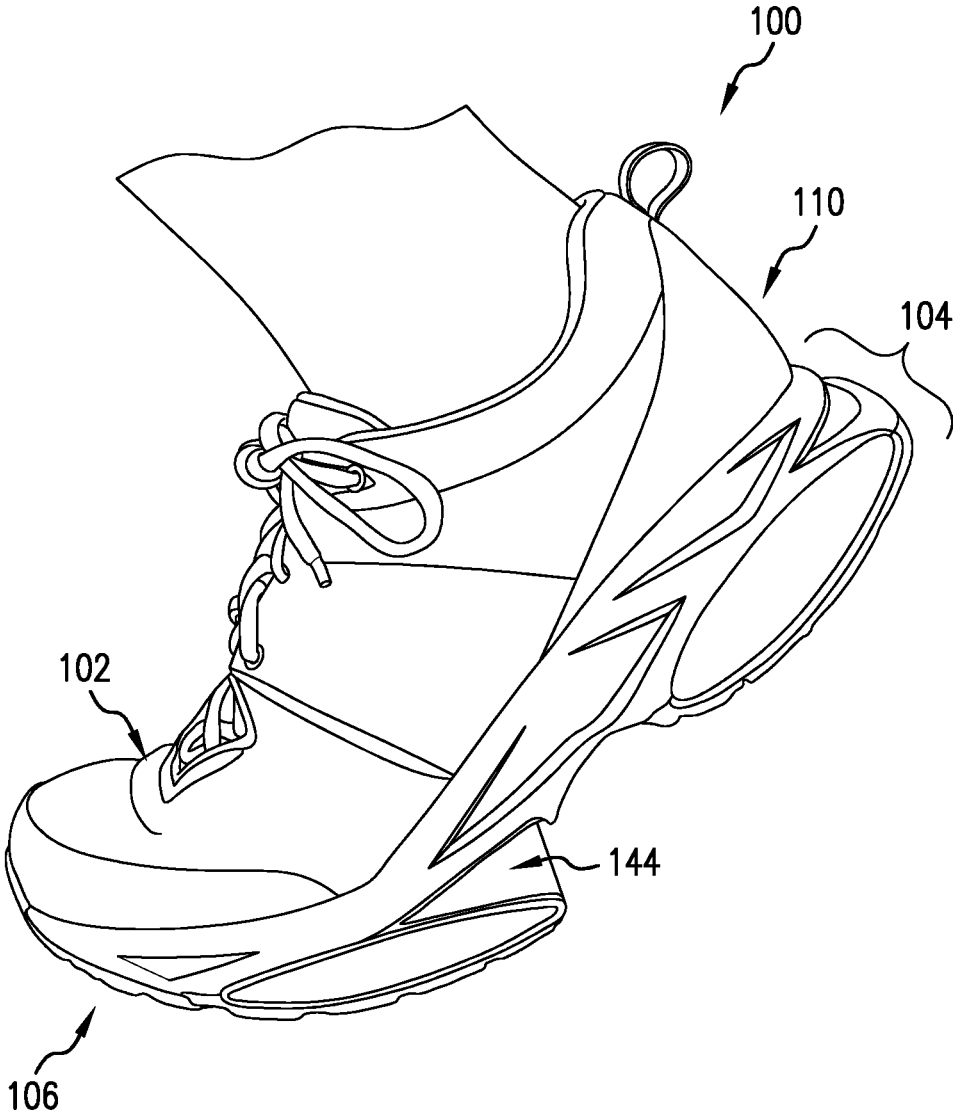
FIG. 1 shows a lateral side view of a shoe according to one embodiment of the invention.

FIG. 1 shows a shoe 100 according to one embodiment of this invention. The shoe as shown includes an athletic shoe, although the present invention may be applied to any number or variety of shoe-types. The shoe 100 generally includes an upper 102 and a sole 104. The upper 102 can house a last (not shown) to generally represent a wearer's foot that may fit inside the shoe 100. The shoe 100 includes a forward region 106, generally represented by a front portion of the shoe 100, where the ball of the foot and toes of a wearer would go. The shoe 100 also includes a rear region 110, generally represented by a rearward portion of the shoe 100, where the heel of a wearer would go. In a preferred embodiment of this invention, the shoe 100 is modeled on an anatomical last.

Figure 2:
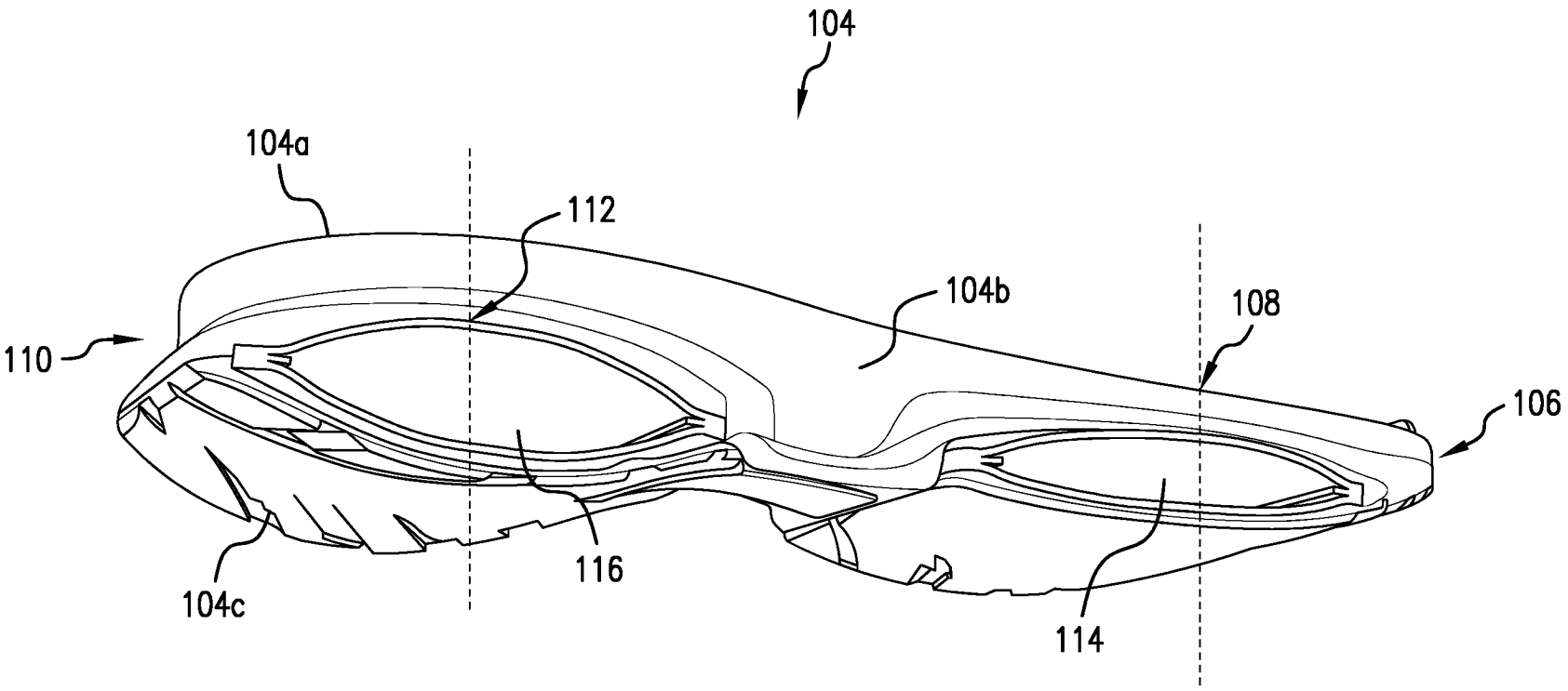
FIG. 2 shows a bottom perspective view of the shoe according to the embodiment shown in FIG. 1.

The sole 104 of the shoe 100 includes an insole 104*a*, a midsole 104*b*, and an outsole 104*c*, as shown in FIG. 2. The insole 104*a* includes a portion of the shoe closest to the last (or the wearer's foot). The outsole 104*c* includes a portion of the shoe closest to the ground. The midsole 104*b* is displaced between the insole and the outsole. The sole also includes one or more integrated suspension elements 114, 116. In the embodiment shown in FIG. 2, the sole includes a forefoot suspension element 114 and a heel suspension element 116. The forefoot suspension element 114 is in the forward region 106 of the shoe, aligned with a forward center of loading 108. The forward center of loading 108 is defined by an area of pressure and force for when a wearer is in a portion of a stride where the weight of the wearer is occurring in the forward region of the shoe.

The heel suspension element 116 is in the rear region 110 of the shoe, aligned with a rear center of loading 112. The rear center of loading 112 is defined by an area of pressure and force for when a wearer is in a portion of a stride where the weight of the wearer is occurring in the rear region of the shoe.

In comparison with the prior art, the forefoot suspension element 114 according to FIG. 2 is preferably significantly larger than the prior art, or oversized, and is designed to have much greater torsional lateral stability than earlier, smaller suspension elements. With an oversized forefoot suspension element, the shoe provides greater linearity of suspension loading and more energy transfer from heel to forefoot. Other embodiments of the invention may further include modifying the sizes and/or quantities of the suspension element(s).

Figure 3:
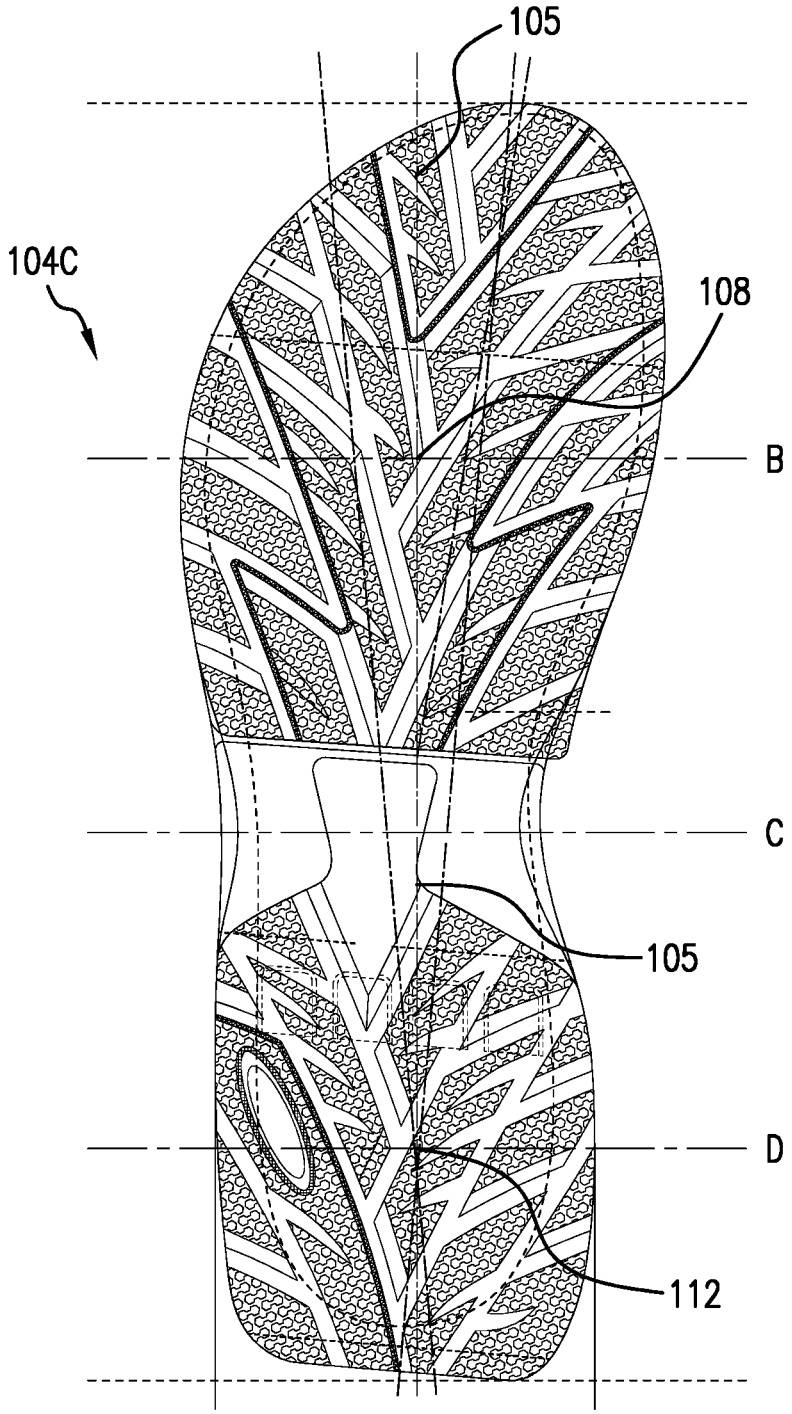
FIG. 3 shows a bottom view of a shoe according to one embodiment of the invention.

FIG. 3 shows a bottom view of the outsole 104*c*. Both the forward center of loading 108 and the rear center of loading 112 are shown across the intersection of a centerline of the outsole 105 and cross-sectional lines B and D, respectively.

Figure 4A:
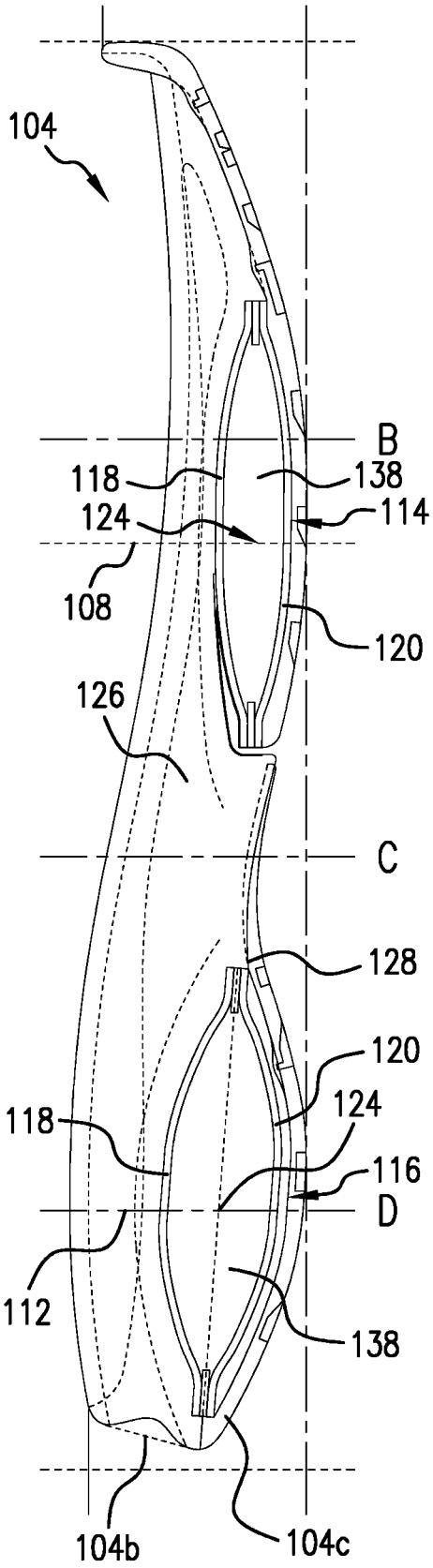
FIG. 4A shows a partial lateral side view of the shoe according to the embodiment shown in FIG. 3.

FIG. 4A shows a lateral side view of the sole 104 of the shoe. Additional details of the integrated suspension elements 114, 116 are seen here. Each of the suspension elements 114, 116 include an upper or convex suspension arm 118 and a lower or concave suspension arm 120. The upper suspension arm 118 is adjacent to, and surrounded by, layers 126 of the midsole 104*b*. The lower suspension arm 120 is adjacent to, and surrounded by, layers 128 of the outsole 104*c*. The upper suspension arm 118 and lower suspension arm 120 connect to form a suspension element 114, 116 that is a mandorla shape. The terms "convex" and "concave" are intended to be defined relative to a generally planar walking or running surface.

The mandorla shape that forms a suspension element according to the present invention may comprise include an almond, marquise, vesica piscis, or other similar shape that is generally formed by two arcs (in this case, a convex arm and a concave arm) that connect at respective pointed ends to form the mandorla shape therebetween.

Figure 4B:
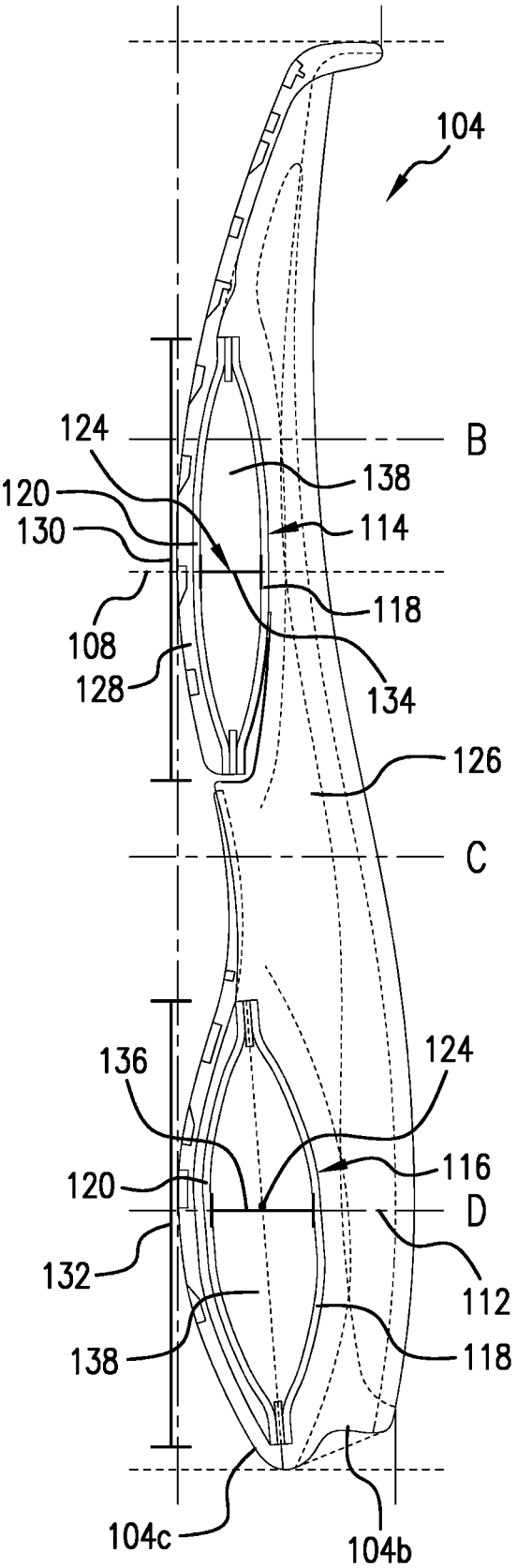
FIG. 4B shows a partial medial side view of the shoe according to the embodiment shown in FIG. 3.

The mandorla shape includes a hollow suspension region 138 between the suspension arms 118, 120. The hollow region 138 extends through a lateral width W of the outsole and midsole (shown in FIG. 6), through to the medial side of the sole 104 as shown in FIG. 4B. Each suspension element 114, 116 preferably includes a center of compression 124. The center of compression 124 is aligned with a respective center of loading 108, 112.

In one embodiment of the invention, the forefoot suspension element is preferably greater than 65 mm long from front to rear, between the ends that join the upper and lower suspension arms. The forefoot suspension element is also preferably more than 9 mm high through a center of the hollow suspension region between the lower suspension arm and upper suspension arm. In one embodiment a forward suspension element includes a length of at least 60-100 mm, with a height of at least 7-20 mm.

In one embodiment of the invention, the rear suspension element is preferably at least 65 mm long from front to rear, between the ends that join the upper and lower suspension arms. The rear suspension element is also preferably at least 14 mm high through a center of the hollow suspension region between the lower suspension arm and upper suspension arm. In one embodiment a rear suspension element includes a length of at least 60-95 mm, with a height of at least 12-30 mm. As such, the forefoot suspension element 114 preferably includes a length 130 that is greater than a length 132 of the heel suspension element 116. The heel suspension element 116 preferably includes a height 136 that is greater than a height 134 of the forefoot suspension element 114.

Figure 5A:
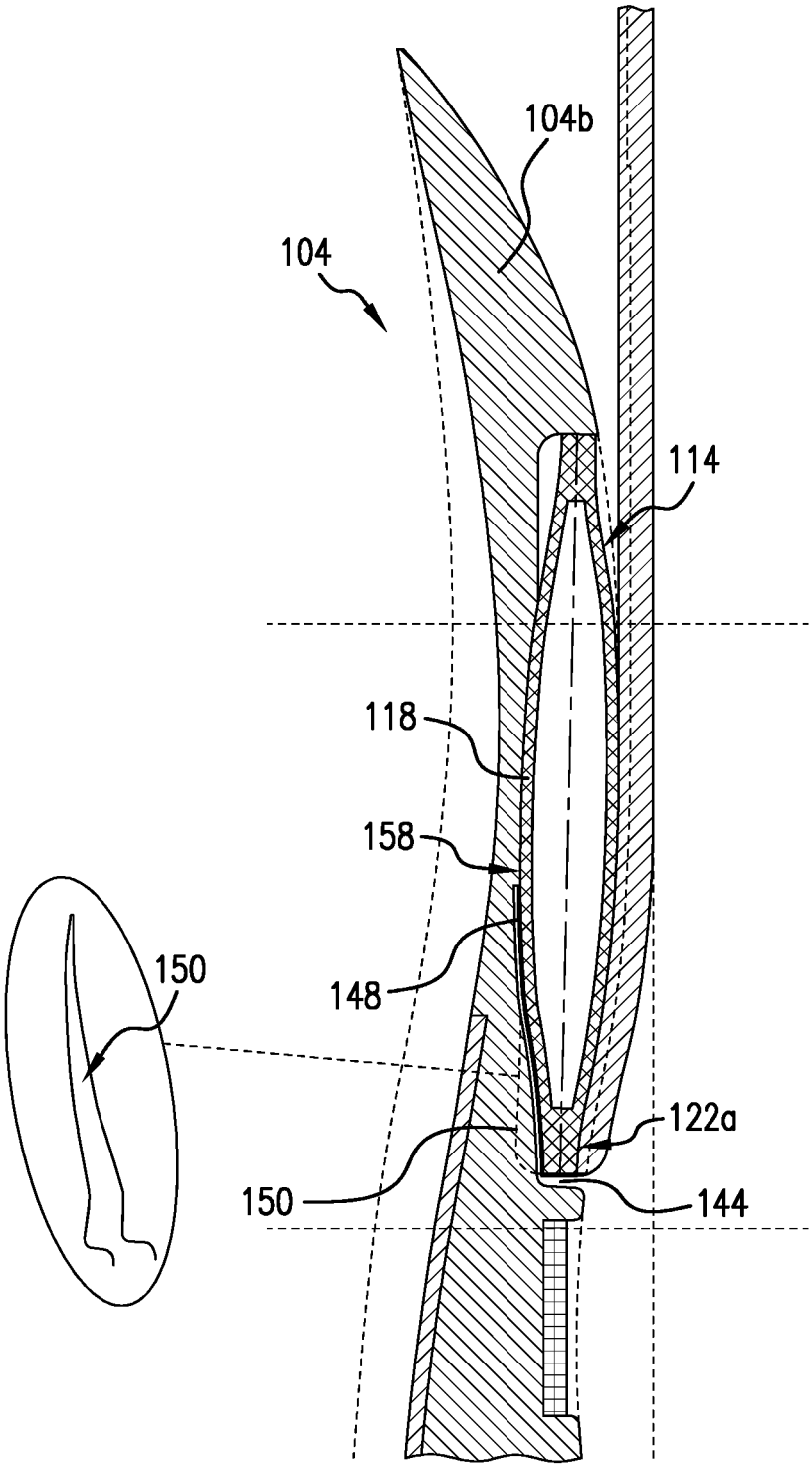
FIG. 5A shoes a partial lateral side view of the shoe according to the embodiment shown in FIG. 3.
Figure 5B:
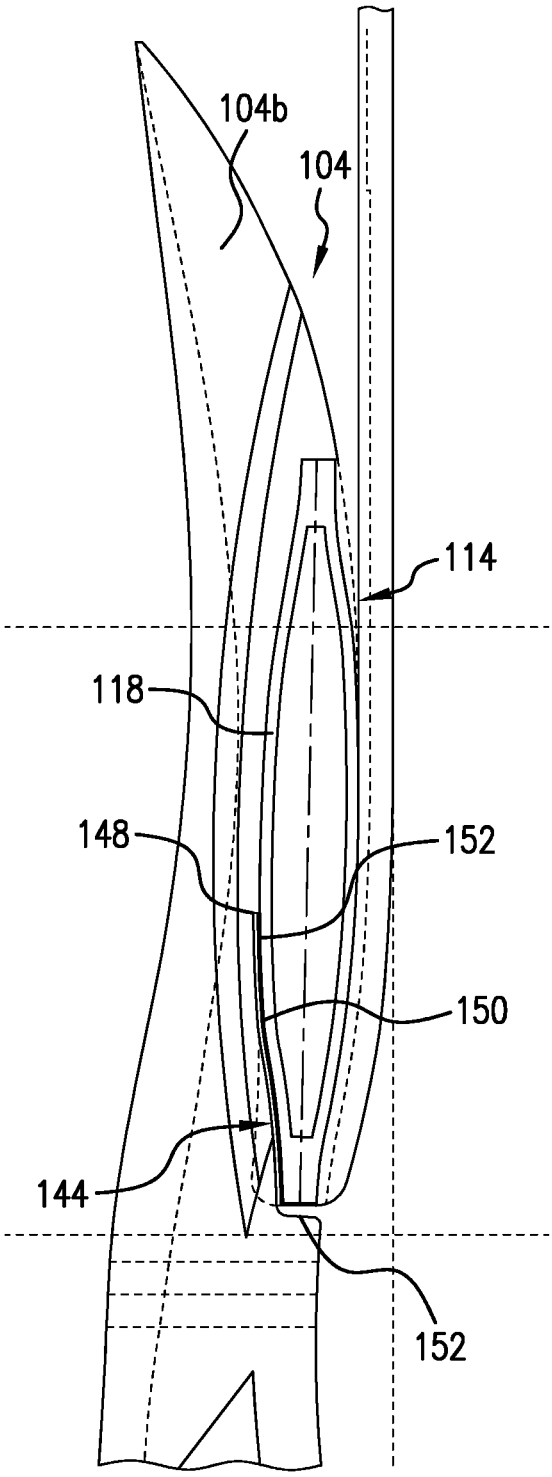
FIG. 5B shoes another partial lateral side view of the shoe according to the embodiment shown in FIG. 3.

FIGS. 5A and 5B show close-up cross-sectional lateral views of the forefoot or forward suspension element 114. As shown, the midsole 104*b* includes an openable cavity 144 between a portion of the midsole 104*b* and a portion of the upper/convex suspension arm 118 of the forefoot suspension element 114. The openable cavity 144 extends laterally a width 146 (see FIG. 6) of the suspension element 114 and extends longitudinally from an end 122*a* of the upper suspension arm 118 to another point 148 along a length 158 of the upper suspension arm 118. When a wearer engages the forward center of loading 108, by placing his/her weight on the ball of the foot, the forward suspension element 114 is engaged, and the openable cavity 144 can open (as shown in FIG. 1).

To maintain the integrity of the openable cavity 144, the midsole 104*b* also includes a fabric border 150 that extends along a perimeter 152 of the openable cavity 144. The fabric border 150 abuts a portion of the midsole 104*b* and a portion of the upper suspension arm 118 of the forward integrated suspension element 114. The fabric border 150 preferably includes a tightly woven fabric or polymer sheet approximately 0.25 mm thick, although other thicknesses may be used. By outlining the perimeter 152 of the openable cavity, the fabric border 150 forms a v-shape (as shown in the detail view of FIG. 5A) in a cross-sectional or side view of the sole 104.

Figure 6:
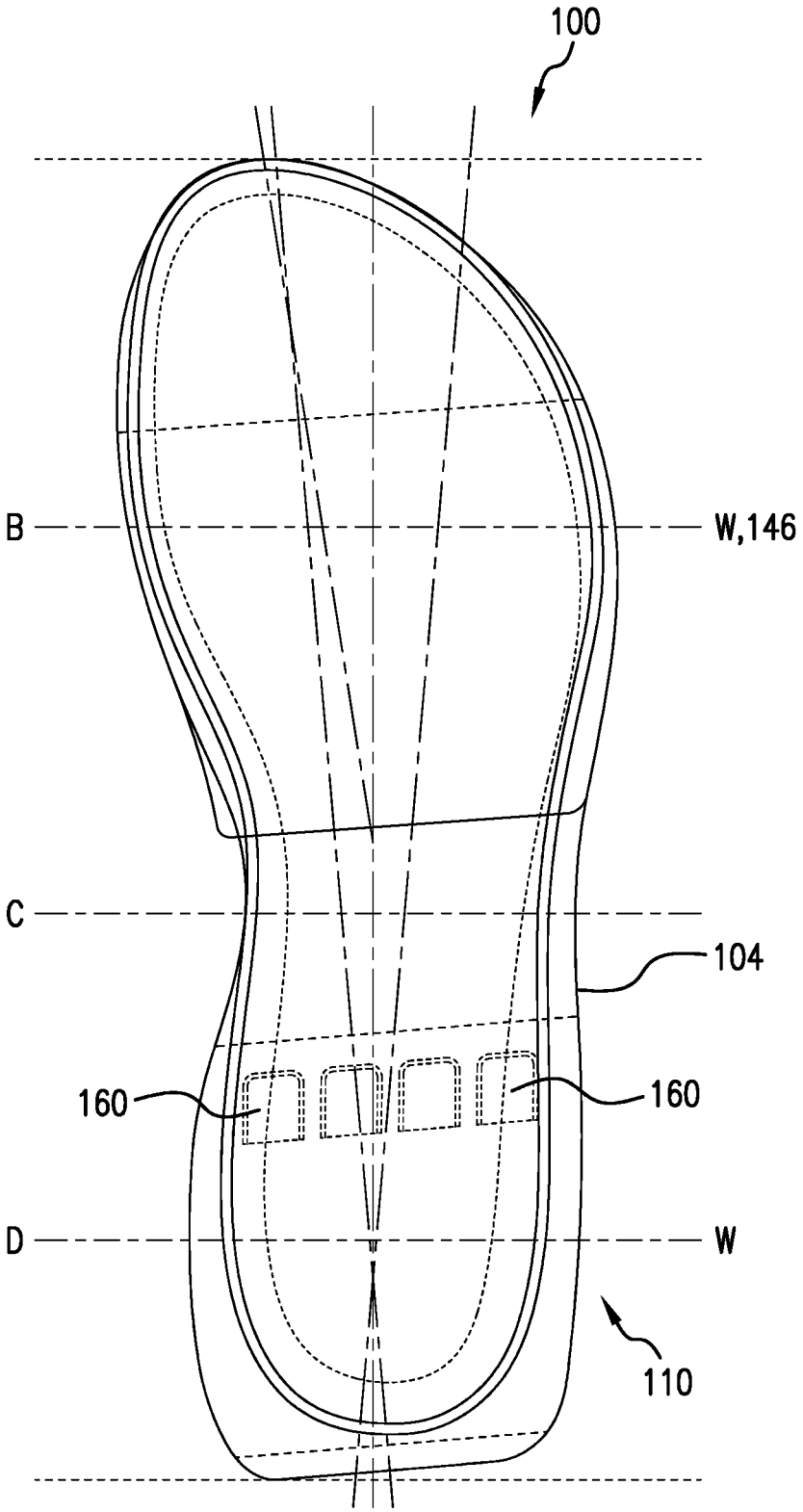
FIG. 6 shows a cross-sectional top view of the shoe according to the embodiment shown in FIG. 3.

FIG. 6 shows a partially-transparent top view of the shoe 100 according to one embodiment of the invention. Here, a portion of the sole 104 includes at least one cavity 160 disposed across a lateral width of the rear integrated suspension element 116, at the rear region 110 of the shoe 100. In some embodiments of the invention, the shoe 100 may include a plurality of cavities 160 disposed generally equidistant across the lateral width of a portion of the midsole. The plurality of cavities 160 are preferably arranged between a portion of the sole 104 and a portion of the upper suspension arm 118 of the rear integrated suspension element 116.

The plurality of cavities 160 are preferably arranged at a leading edge of the rear region 110 of the shoe. As shown in FIG. 6, the plurality of cavities 160 may include four evenly spaced suspension flex pockets to the leading edge of a heel portion of the midsole 104*b*. These pockets or cavities are preferably about 12 mm wide by 13-15 mm deep and 6 mm high at one end. The three-dimensions may vary across each individual cavity. The cavities may generally be rectangularly-shaped as shown, although other shapes may be used as well. The cavities allow the upper suspension arm of the rear suspension element to flex more evenly and symmetrically in tandem with the lower suspension arm of that suspension element.

Figure 7:
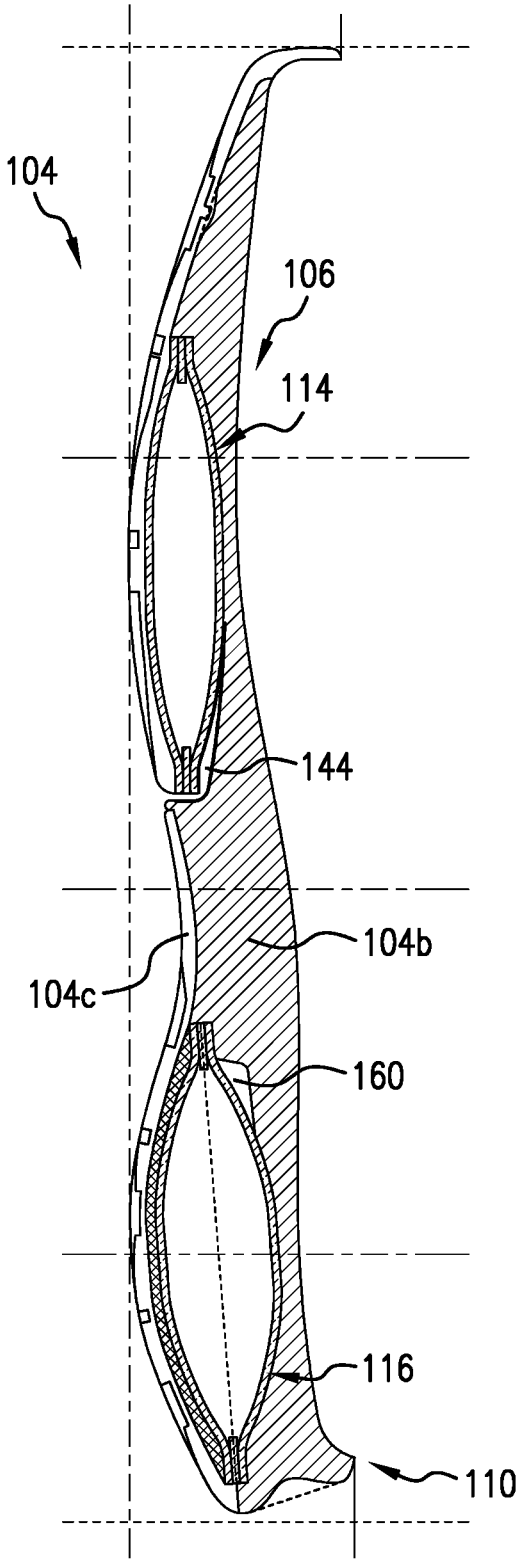
FIG. 7 shows a cross-sectional side view of the shoe according to the embodiment shown in FIG. 3.
Figure 8:
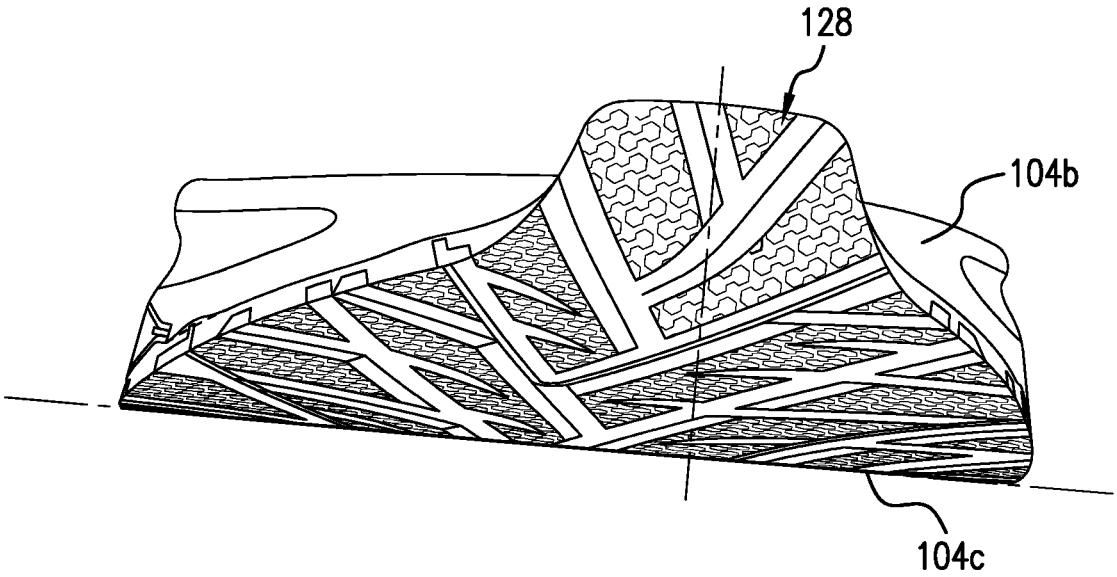
FIG. 8 shows a partial front view of the shoe according to the embodiment shown in FIG. 3.
Figure 10:
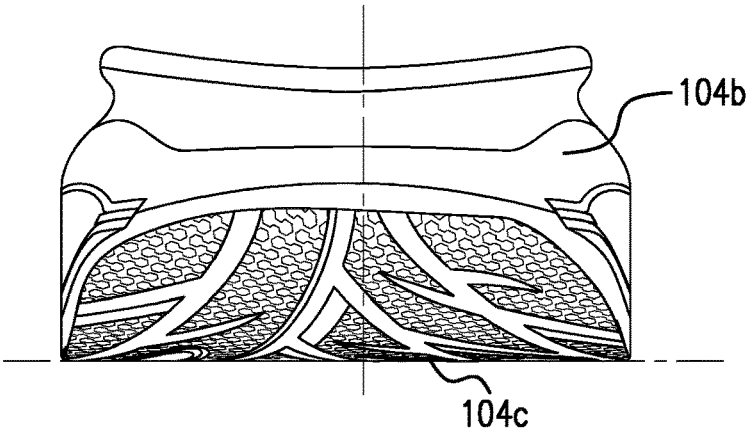
FIG. 10 shows a partial rear view of the shoe according to the embodiment shown in FIG. 3.

Both the at least one cavity 160 of the rear region 110 of the shoe, as well as the openable cavity 144 of the forward region 106 of the shoe are shown in the cross-sectional view of the sole 104 of FIG. 7. The midsole 104*b* and the outsole 104*c* each include a plurality of layers 126, 128 within the shoe 100. A portion of such layers are similarly shown in the toe or front view of the sole 104 of FIG. 8, or the heel or rear view of the sole 104 of FIG. 10.

Figure 9:
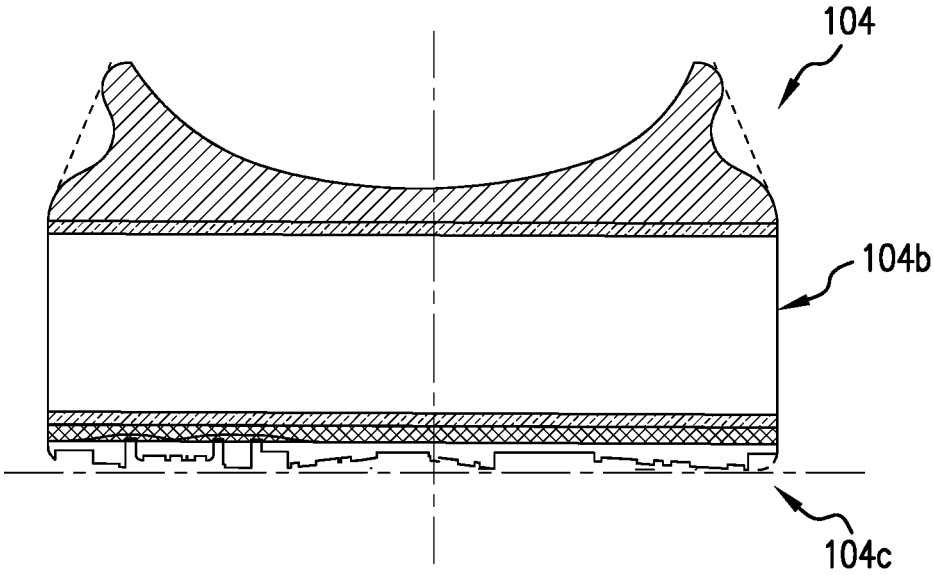
FIG. 9 shows a partial cross-sectional view of the shoe according to the embodiment shown in FIG. 3.
Figure 11:
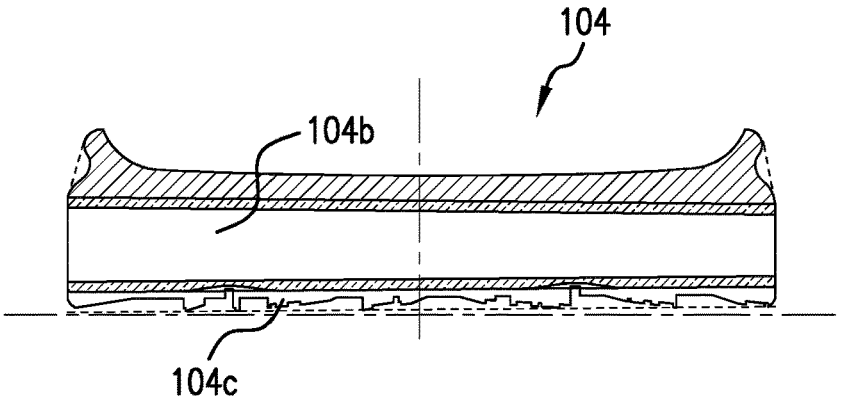
FIG. 11 shows a partial cross-sectional view of the shoe according to the embodiment shown in FIG. 3.
Figure 12:
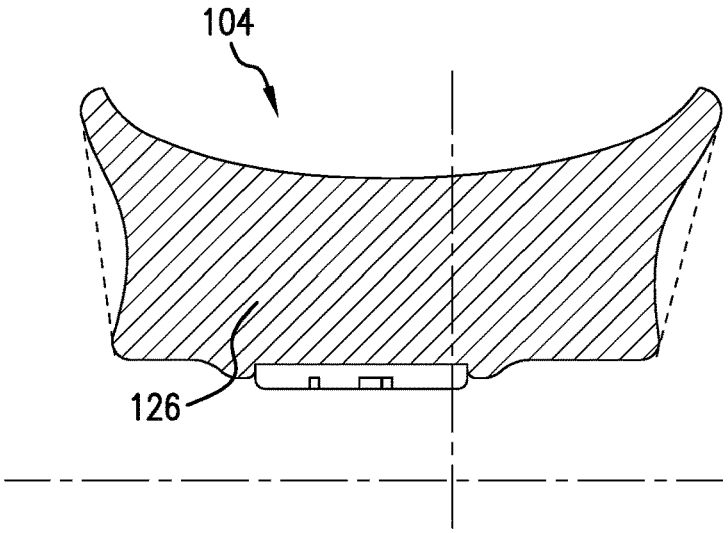
FIG. 12 shows a partial cross-sectional view of the shoe according to the embodiment shown in FIG. 3.

Additionally, FIG. 9 shows a cross-sectional view of the sole 104 from cross-sectional line D shown in FIGS. 3-7. FIG. 11 shows a cross-sectional view of the sole 104 from cross-sectional line B shown in FIGS. 3-7. FIG. 12 shows a cross-sectional view of the sole 104 from cross-sectional line C shown in FIGS. 3-7. Such views include representations of the multiple layers 126, 128 and materials of portions of the sole 104 according to various embodiments of the invention.

One embodiment of the present invention includes a suspension-specific anatomic last. This last places the big toe of a wearer in a position where the toe can essentially "roll off" of a forefoot suspension element so that the big toe (and the rest of the foot following) can land in a more powerful, anatomically aligned position when compared to the prior art. This leads to a more powerful toe-off portion of a stride when a user is walking or running.

Figure 13B:
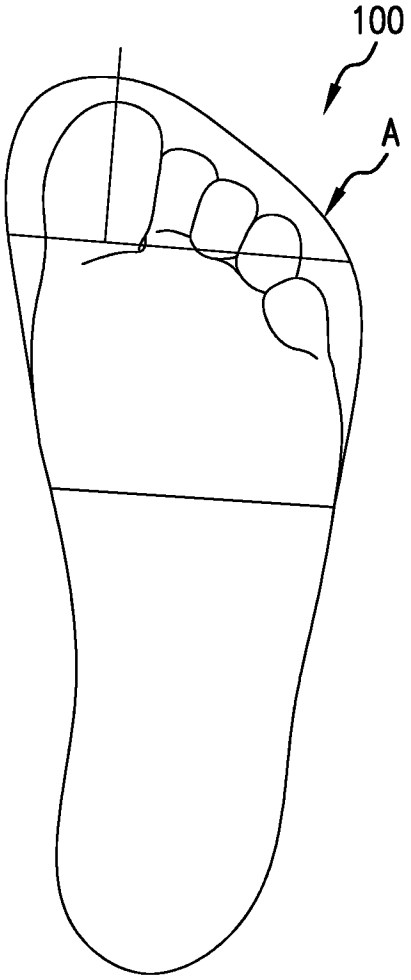
FIG. 13B shows a partial top view of a shoe according to one embodiment of the invention.
Figure 13A:
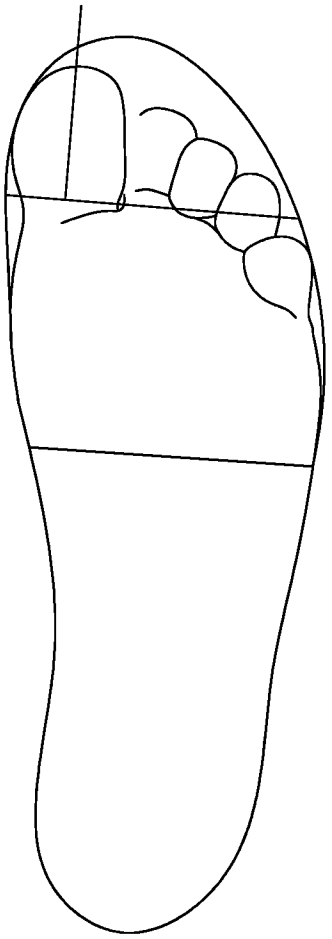
FIG.13A PRIOR ART
FIG. 13A shows a partial top view of a shoe according to the prior art.

FIG. 13A shows a cross-sectional top view of a conventional last (a foot representation) according to the prior art. Such a conventional last misaligns forefoot anatomy by putting lateral pressure on a side of the big toe and pinky toes, leading to improper toe-off tracking. A conventional last pushes the big toe towards the midline of the foot which loses both energy transfer and stability in completing a stride. When the big toe is shoved over towards the midline, this encourages and can cause pronation of the ankle. This can cause plantar, ankle, knee, hip or iliotibial pain. This also causes a less efficient transfer of energy during the critical toe-off portion of a stride and can lead to instability during a subsequent heel strike. As a result, it is common for runners to have large calluses on the medial side of their big toes.

FIG. 13B shows an anatomic last with a forefoot suspension accommodation according to one embodiment of the invention. Here, a surface area A of the last allows for room to splay out toes, correcting the toe-off tracking of the prior art. A forward suspension element according to one embodiment is preferably aligned with a knuckle of a user's big toe. Forward alignment of the big toe is enabled by the larger toe box of the anatomic last. There is ample room for the big toe to plant itself naturally and firmly during a toe-off portion of a stride.

The last according to the embodiment shown in FIG. 13B works integrally with a hinge and forefoot suspension to guide a force of suspension energy release through the big toe and into the ground efficiently. This leads to conservation in an energy path of a stride of a wearer, from a heel-in through a toe-off portion of a stride.

The anatomic last according to the subject invention also contributes to a medial/lateral suspension area balance. By treating the shoes "flight dynamics" more like a boat or airplane, the shoe according to the subject invention can improve lateral pressure distribution on suspension elements along a midline of a foot, running from the second metatarsal to the heel calcaneus bone. This distribution measures and equalizes an area of suspension on either side of the second metatarsal to calcaneus line.

This is unlike lasts according to the prior art which encourage placing suspension elements in a position that creates a dynamically unbalanced medial/lateral pressure loading. Such lasts, such as those discussed in the '351 patent, are deficient on the medial side of the shoe. The result is excessive pronation of the ankle and knee with patellar pain and iliotibial band pain.

Figure 14B:
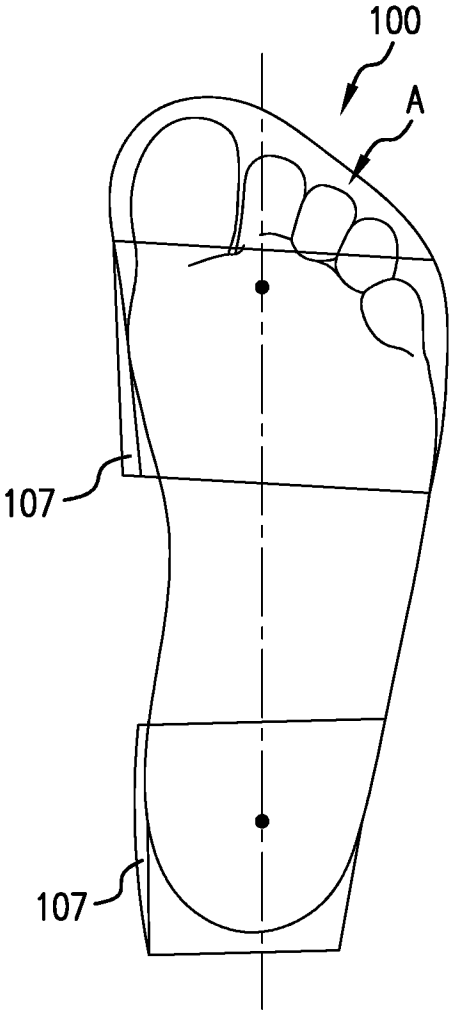
FIG. 14B shows a partial top view of a shoe according to one embodiment of the invention.
Figure 14A:
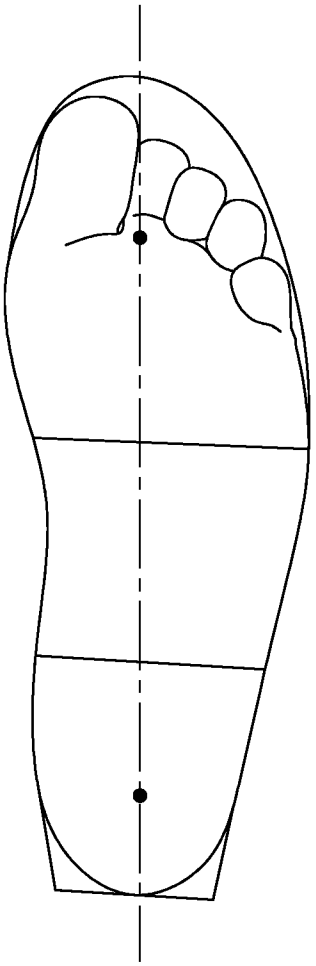
FIG.14A PRIOR ART
FIG. 14A shows a partial top view of a shoe according to the prior art.

Another object of the subject invention that is an improvement over the prior art includes medial side suspension elements 107 that preferably protrude from an outside of a footprint of the sole to create a centering effect, such as shown in FIG. 14B. In the prior art, as shown in FIG. 14A, the area of a footprint of the sole is different on the medial side versus the lateral side of the foot. In the subject invention, according to FIG. 14B, the area A of the footprint is equalized on both sides. This is particularly beneficial in a woman's shoe, and such a shoe can have a greater area on a medial side of the shoe to accommodate a woman's hip q-angle.

Women's shoes according to the subject invention will preferably have an increased medial/lateral loading balance on the medial side of a shoe to provide better stride stability for a more acute femur to patella "Q-angle." This provides an additional value in reducing torsional stress in joints during running. The medial/lateral loading balance may further be modified to ensure better stride stability for a variety of types of shoes, whether particularly designed for men, women, children, a particular shape or size of foot, a unique condition, or any combination thereof. The loading balance may be modified to suit an individual's needs to provide a better stride stability for any type of wearer.

Figure 15A:
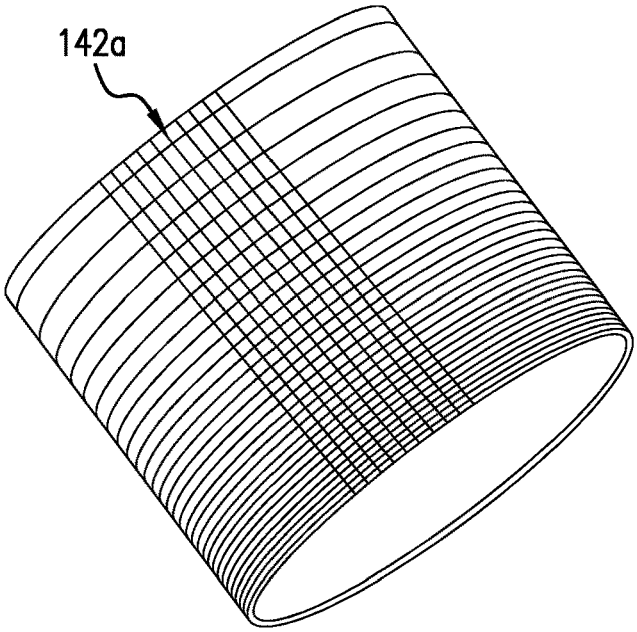
FIG.15A PRIOR ART
FIG. 15A shows a perspective view of a portion of a shoe according to the prior art.

FIGS. 15A and B show versions of isolated suspension elements according to the prior art. Such versions are further shown and explained in FIGS. 22 and 25 of the '351 patent. FIG. 15A shows a suspension element with primarily longitudinal fibers, coupled with a small amount of lateral fibers 142*a*. This suspension element, according to the prior art, contains less than 5% of lateral fibers, whereas suspension elements of the claimed invention preferably include 20% or more lateral fibers.

Figure 15B:
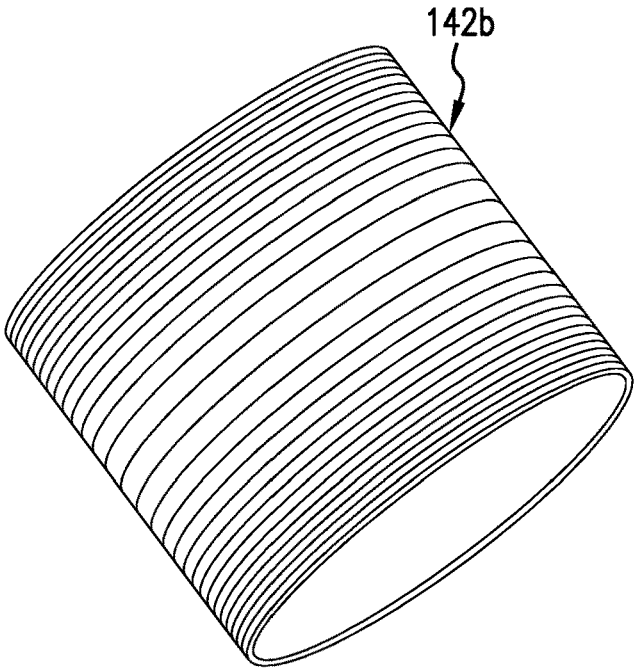
FIG.15B PRIOR ART
FIG. 15B shows a perspective view of a portion of the shoe according to the embodiment shown in FIG. 15A.

FIG. 15B shows a suspension element with all longitudinal fibers 142*b*. This suspension element, according to the prior art, contains at least 95% longitudinal fibers, whereas suspension elements of the claimed invention preferably include less than 80% longitudinal fibers.

Suspension elements according to embodiments of the subject invention may include a totality of fibers biased at angles and amounts so as to create resistance to lateral collapse, or increased torsional lateral stability.

Figure 16A:
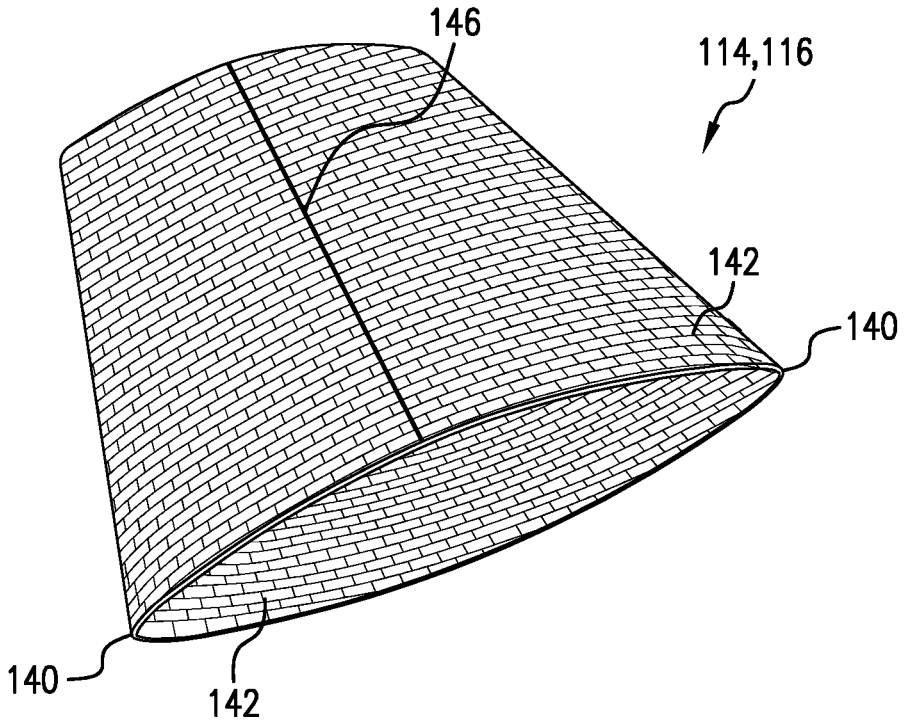
FIG. 16A shows a perspective view of a portion of a shoe according to one embodiment of the invention.

FIGS. 16A and B show versions of isolated suspension elements 114, 116 according to the present invention. Each of the suspension elements 114, 116 shown, include a lateral width 146 that extends through a portion of the sole when inserted into a shoe. FIG. 16A shows polypropylene fibers 142 (or similar) wrapped longitudinally around apex joints 140 of the suspension element 114, 116. This reduces or eliminates epoxy micro-cracking from concentrated stress in these joint areas of the suspension elements. A two-piece suspension element (including upper and lower suspension arms) also aids in reducing or eliminating epoxy micro-cracking in the fibers of the suspension element.

Figure 16B:
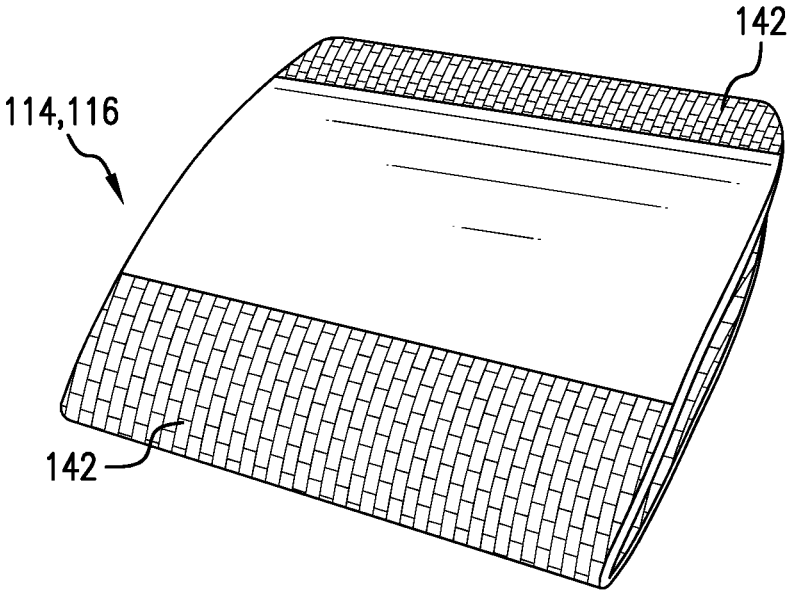
FIG. 16B shows a perspective view of a portion of a shoe according to the embodiment shown in FIG. 16A.

As such, the material(s) of the suspension element(s) according to the subject invention, preferably closely mimic properties of toughened epoxy matrix resins. One such example includes high-modulus polypropylene fibers wrapped longitudinally around the inside and outside of a carbon suspension core. The polypropylene fibers reinforce toughened epoxy and resist onset of micro cracking of the epoxy, which also prevents zipper fiber failures across the suspension element. As shown in FIG. 16B, the polypropylene fibers 142 for the suspension element may be laid up as unidirectional fiber, fabric, filament wound on a mandrel, or other constructions as well.

Figure 17A:
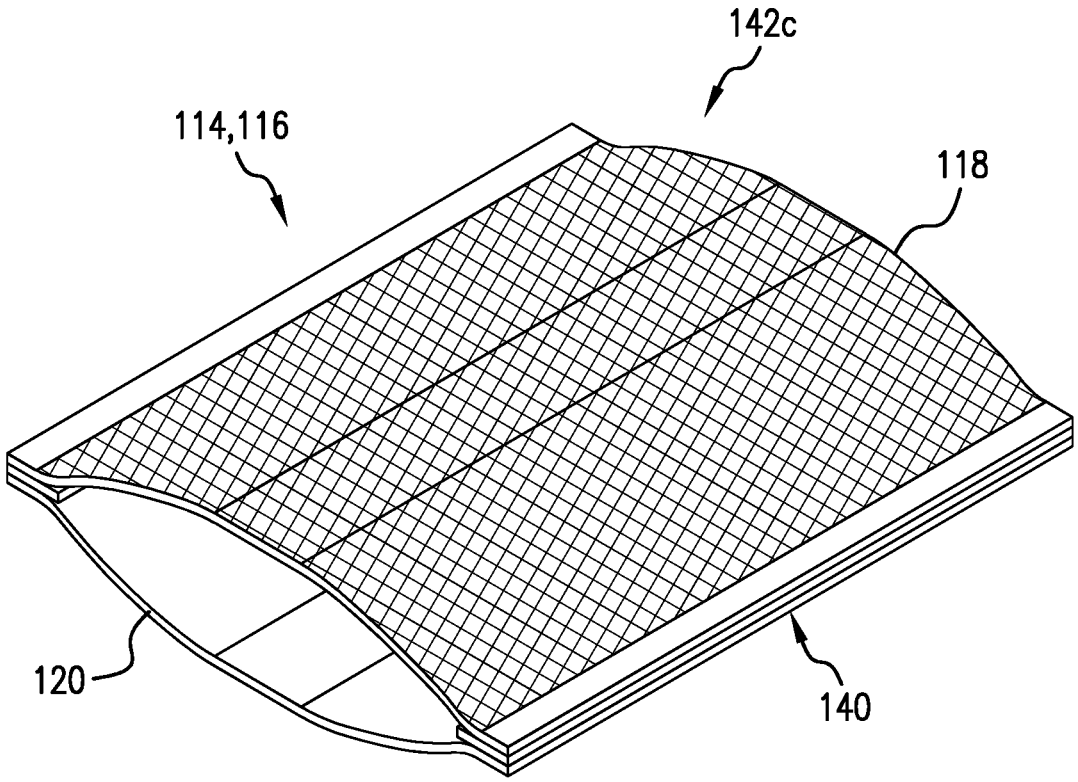
FIG. 17A shows a perspective view of a portion of a shoe according to one embodiment of the invention.
Figure 17B:
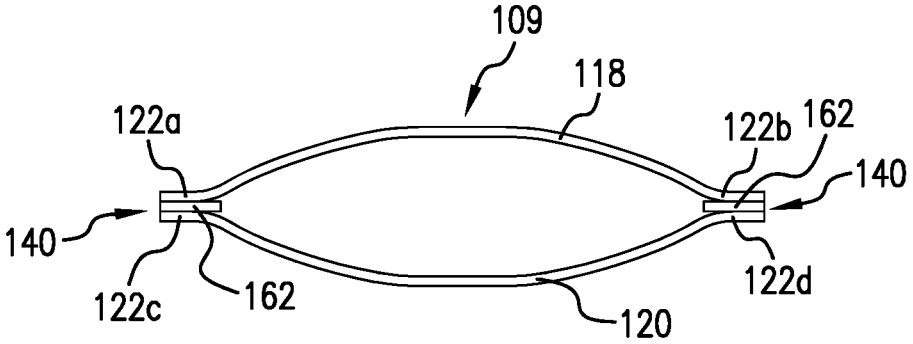
FIG. 17B shows a side view of a portion of a shoe according to the embodiment shown in FIG. 17A.
Figure 17C:
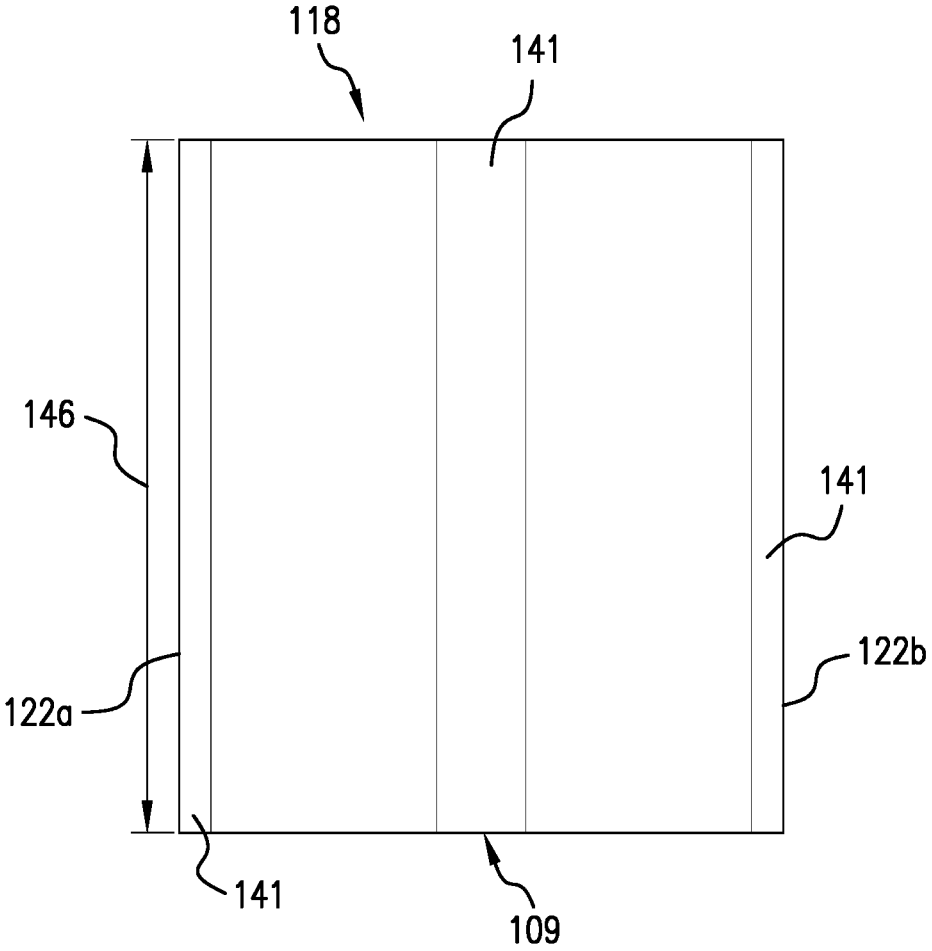
FIG. 17C shows a top view of a portion of a shoe according to the embodiment shown in FIG. 17A.

FIGS. 17A-C shown additional details of a suspension element 114, 116 according to the subject invention. FIG. 17A shows a suspension element 114, 116 with an upper suspension arm 118 and a lower suspension arm 120. Ends 122*a*, 122*b* of the upper suspension arm 118 are joined with ends 122*c*, 122*d* of the lower suspension arm 120, as shown in FIG. 17B. The respective ends of the suspension arms are joined at joints 140 with an elastomer 162 (discussed further below in FIG. 18A). The elastomers 162 are preferably made of natural rubber, approximately 1.5 mm thick, although other materials and thickness may be used. The upper suspension arm 118 is preferably made of 10 layers of alternating biased unidirectional carbon fiber.

FIG. 17A also shows the suspension element with biased fibers 142*c*. Suspension elements according to the prior art contained less than 5% of biased fibers, whereas suspension elements of the claimed invention preferably include up to 100% of biased fibers. The biased fibers of the claimed invention are preferably biased against one another at varying angles of 10°-40°, more preferably 20°-30° in order to maximize torsional lateral stability. The angles of the fibers are determined relative to a longitudinal heel-to-toe direction representing an angle of 0°. The biased fibers may be biased at consistent angles, or they may also be biased at varying, different angles, throughout areas of the suspension element(s).

A top view of the upper suspension arm 118 is further shown in FIG. 17C. Here, the lateral width 146 of the suspension element is observed. Also shown are additional fiber reinforcements 141 that may be placed at desired regions of the suspension element. As shown, these reinforcements 141 may be ideally placed on areas of the suspension element most prone to stress and wear, such as a center 109 of a suspension arm and/or at the respective ends 122*a-d* of a suspension arm as shown. In addition, the upper and/or lower suspension arms of a suspension element may include near-flat centers 109 with a modest radius. These near-flat centers reduce or eliminate suspension position sensitivity (or "hot spots") for the wearer. These centers also allow the shoe to accommodate a wider range of foot anatomy due to a less critical foot positioning.

Figure 18A:
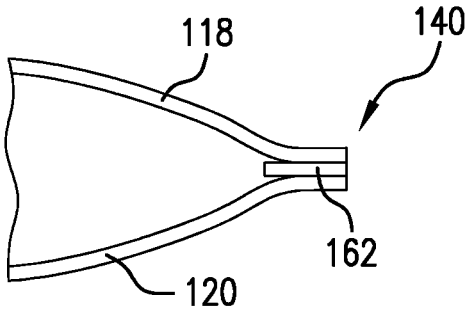
FIG. 18A shows a partial cross-sectional view of a portion of a shoe according to one embodiment of the invention.
Figure 18B:
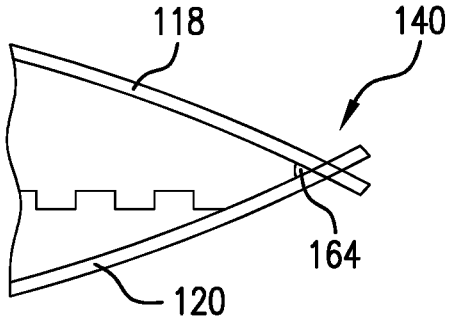
FIG. 18B shows a partial cross-sectional view of a portion of a shoe according to one embodiment of the invention.

To further improve the integrity of suspension elements in the subject invention, the two-piece design (including the upper/convex suspension arm joined with the lower/concave suspension arm) may be joined in a variety of ways. One such example of a two-piece apex joint hinge design 140 includes an elastomer 162 as shown in FIG. 18A (as also shown in FIGS. 17A-B above). The elastomer 162 preferably includes latex rubber and may also include a type of glue to attach respective ends of the suspension arms. FIG. 18B shows another joint hinge design 140 that includes a silicone bead 164. In this example, fiber to form the upper and lower suspension arms is cut to leave overlapping tabs that bear an opposing carbon. These overlapping tabs can be configured to attached to one another and include the silicone bead 164 to maintain said attachment.

Figure 18C:
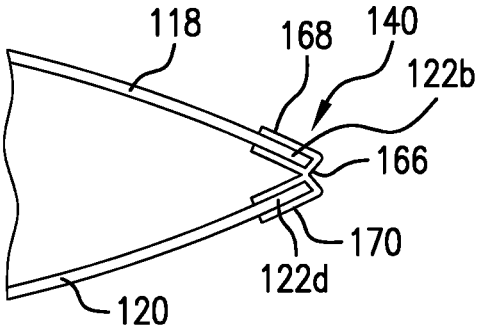
FIG. 18C shows a partial cross-sectional view of a portion of a shoe according to one embodiment of the invention.

FIG. 18C shows yet another joint hinge design 140 that includes a polymer hinge 166. The polymer hinge 166 is preferably a live hinge, made of nylon, polypropylene or similar material. The hinge 166 includes a first insert 168 and a second insert 170. The inserts 168, 170 are arranged so that an end 122*b* of one suspension arm 118 plugs into the first insert 168, and an end 122*d* of another suspension arm 120 plugs into the second insert 170.

Figure 18D:
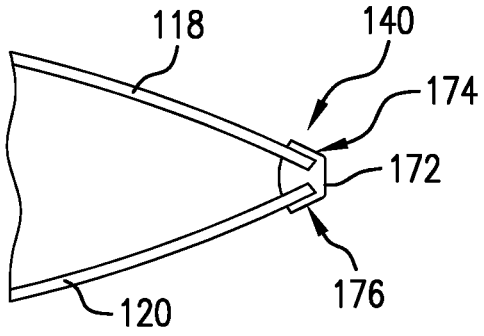
FIG. 18D shows a partial cross-sectional view of a portion of a shoe according to one embodiment of the invention.

FIG. 18D shows another joint hinge design 140 that includes an elastomer hinge 172. The elastomer hinge 172 is preferably a live hinge made of a rubber material, or another material with similar properties. The elastomer hinge 172 includes a first portion 174 that accepts an end of a suspension arm, and a second portion 176 that accepts another end of a suspension arm.

By separating the suspension elements of the subject invention into upper and lower halves with apex joint elastomers, polymers or mechanical hinges, flex patterns and ratios can be altered between upper and lower halves (arms) of suspension elements, and the hinge area can flex naturally with little energy loss. The joints that connect the suspension arms may be mechanical, elastomeric, polymer live-hinges, or any other suitable hinge design.

Figure 19:
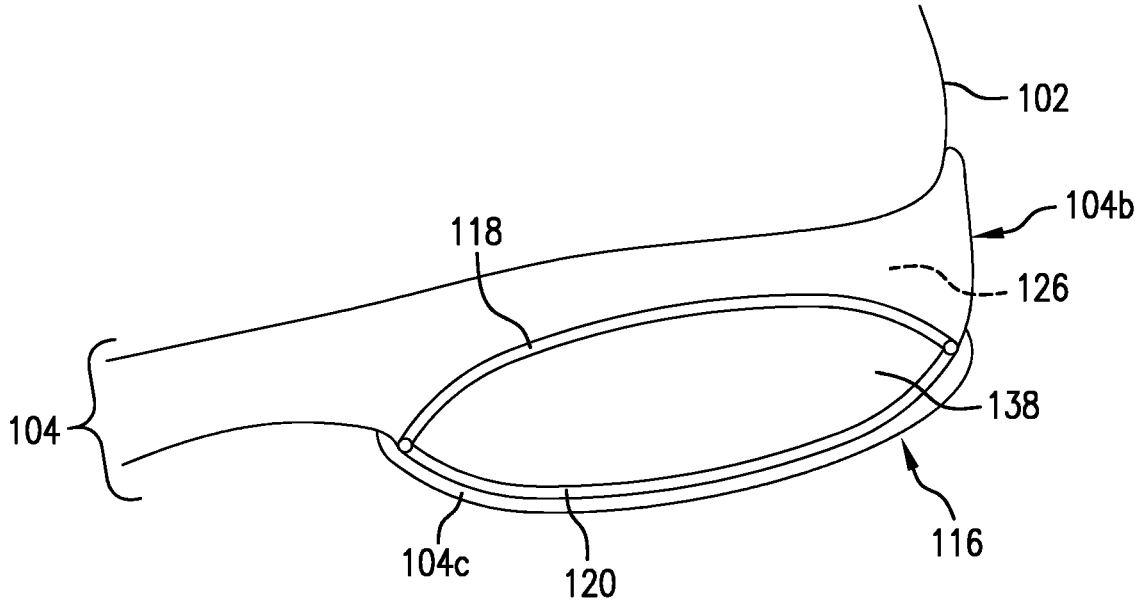
FIG. 19 shows a partial side view of a shoe according to one embodiment of the invention.

One such flex pattern/altered ratio according to an embodiment of the subject invention includes the suspension element 116 shown in FIG. 19. The heel suspension element 116 includes an upper suspension arm 118 that has a composite stiffness that differs from a lower suspension arm 120. The suspension arms 118, 120 have an asymmetrical composite stiffness to balance total stiffness of the sole 104 of the shoe. This balance is achieved as the upper suspension arm 118 is less stiff and/or more flexible in comparison to the lower suspension arm 120 because layers 126 of the midsole 104*b* preferably include EVA, which adds overall stiffness.

The upper suspension arm 118 of the suspension element 116 is nested into the midsole 104*b* and thus is correspondingly stiffer overall than the lower suspension arm 120. The stiffness of the upper suspension arm 118 is therefore reduced compared to the lower suspension arm 120, to achieve an equal spring rate from both arms in conjunction with the sole 104. This reduces or eliminates unbalanced failure stresses between the upper and lower arms of suspension elements throughout the shoe.

Figure 20A:
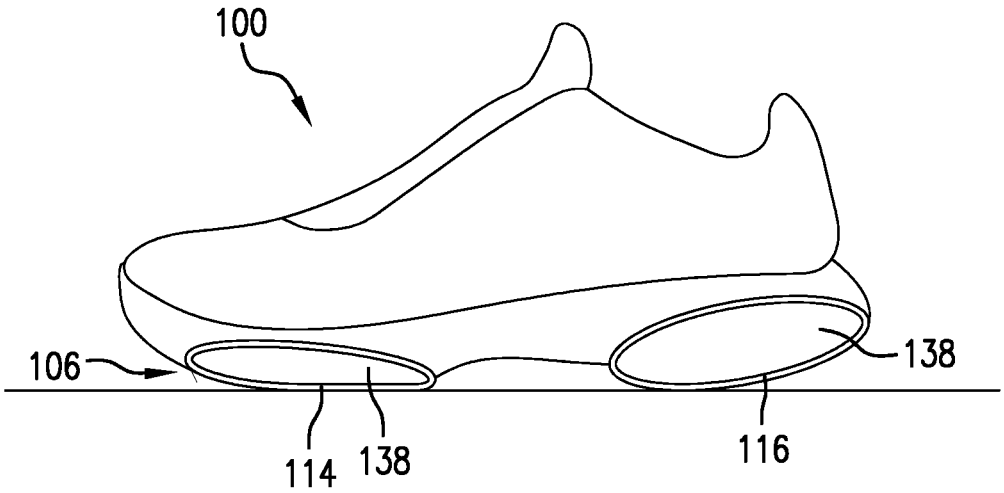
FIG. 20A shows a side view of a shoe according to one embodiment of the invention.
Figure 20B:
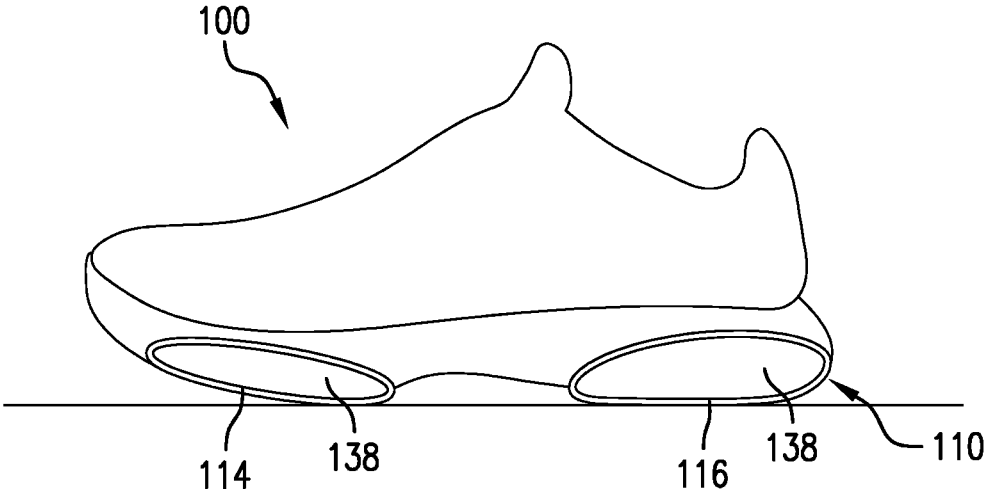
FIG. 20B shows a side view of the shoe according to the embodiment shown in FIG. 20A.

Another advantage of the shoe of the subject invention over the prior art, includes an improved variable drop with regard to including oversized suspension elements. A conventional foam shoe has a higher heel than toe height. This is referred to as "drop". A variable drop is shown in FIGS. 20A and 20B. FIG. 20A shows the shoe 100 with a forefoot and heel suspension element 114, 116 where the forefoot suspension element 114 is partially compressed (where weight is pressed on the forward region 106 of the shoe 100). FIG. 20B shows the shoe 100 where the heel suspension element 116 is partially compressed (where weight is pressed on the rear region 110 of the shoe 100).

Compressing the rear region 110 or heel portion of the shoe during stride entry (or landing), can drop the heel of the shoe by approximately 3-15 mm. The actual drop of the heel will vary according to each individual wearer of the shoe. This "variable drop" is accomplished by a compressible travel of one or more of the oversized suspension elements 114, 116. By compressible travel, a height of a suspension element is capable of being reduced, reducing the area of the hollow suspension region 138. Preferably, the variable drop varies between the forefoot and heel suspension elements, in conjunction the varying sizes (in length and in height) between the forefoot and heel suspension elements. An example is discussed below at FIG. 28B.

The "variable drop" geometry of one or more of the suspension elements aids a foots motion through a stride, resulting in a smoother and more efficient stride when running or walking. By minimizing abrupt stride dynamic "starts and stops" the lower leg/foot is better guided through a stride with less energy loss and greater stability.

Figure 21:
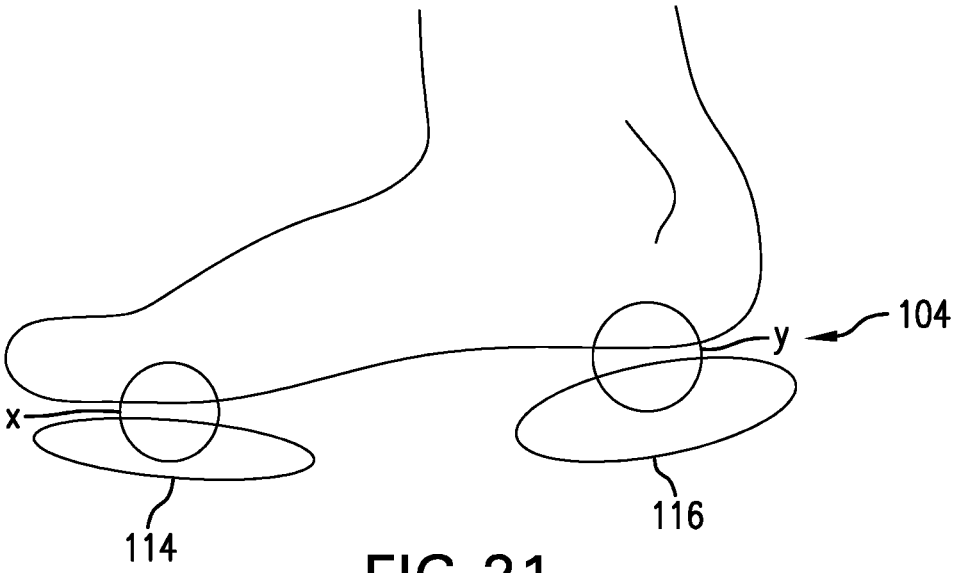
FIG. 21 shows a partial side view of a shoe according to one embodiment of the invention.

To further improve energy transfer and lateral stability, embodiments of the invention can include a reduced foam/fabric thickness in portions of the sole, as shown in FIG. 21. Localized areas X, Y of the sole 104 around the suspension elements 114, 116 can be modified with a lower ride height. A lower ride height provides increased efficiency through more direct energy transfer from a wearer's metatarsal and calcaneus bones to the forefoot 114 and heel 116 suspension elements. Shoes according to the prior art include 10-12 mm of foam between a wearer's foot and suspension elements. In FIG. 21, this material thickness is decreased down to preferably 5-8 mm for increased lateral stability and increased energy transfer to the suspension elements.

Figure 22:
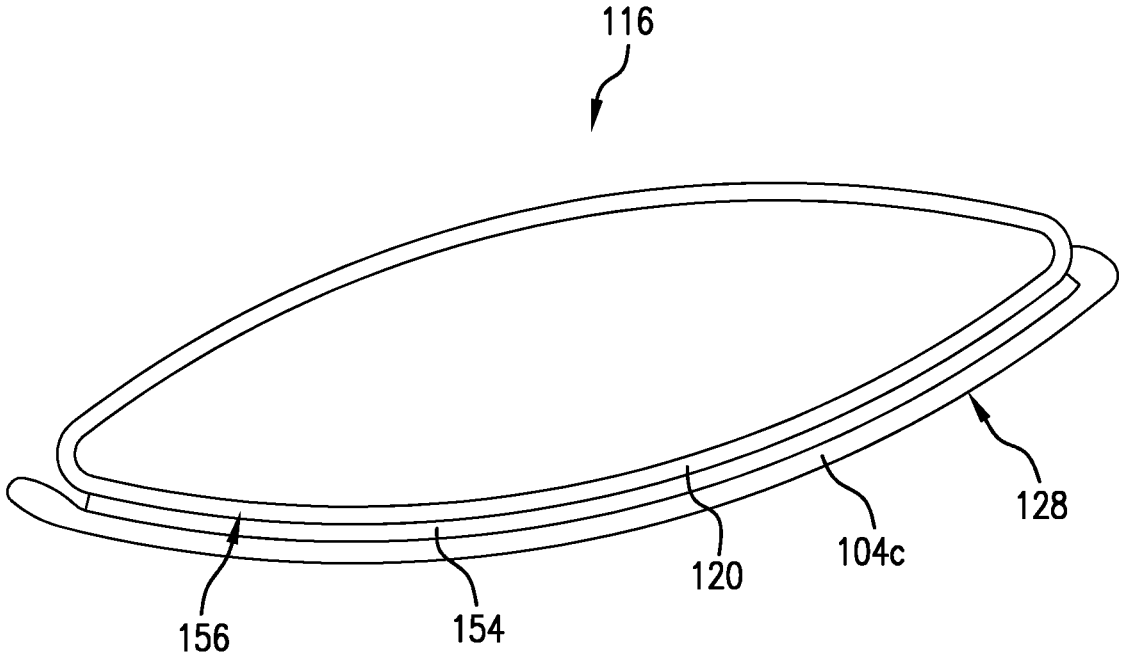
FIG. 22 shows a partial side view of a shoe according to one embodiment of the invention.

FIG. 22 shows an isolated view of the heel suspension element 116. The heel suspension element 116 includes an outsole 104*c* of rubber layer(s) 128 and an additional compressible shear layer 154. The compressible layer 154 sits between the outsole 104*c* and the lower suspension arm 120 of the heel suspension element 116. The compressible layer 154 extends along a length 156 of the lower suspension arm 120. The layer 154 is preferably a soft, compressible layer that shears or displaces laterally to reduce and spread contact abrasion loads on the rubber outsole 104*c*. The material of the layer 154 preferably includes a very low durometer and is laterally stretchy, and is generally made from EPDM or a neoprene elastomer, although other materials may be used. The function of this layer is to decelerate the heel upon ground contact and smooth the heel entry into a walk/run stride.

The compressible layer 154 may be made a bright or contrasting color, in comparison with the other adjacent shoe components. As such, this colored layer can act as an outsole wear indicator. The appearance of the layer can indicate to the wearer that repair or replacement of the outsole of the shoe is needed.

Figure 23:
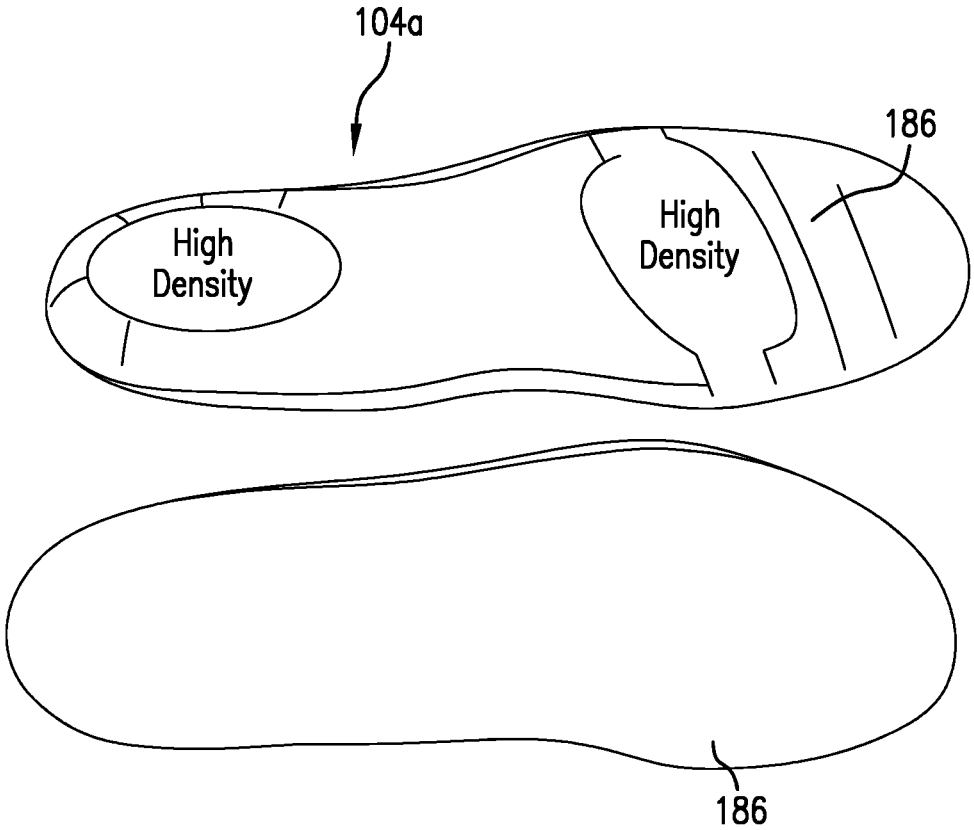
FIG. 23 shows a liner for a shoe according to one embodiment of the invention.

Energy transfer to the suspension elements of the shoe is further enhanced with a high-density sock liner 186, as shown in FIG. 23. The insole 104*a* includes the sock liner 186, to sit underneath a last/foot in the upper of the shoe. The liner preferably includes a high-density foam with a low compressibility to more efficiently transfer energy from a foot through to at least one suspension element.

Figure 24:
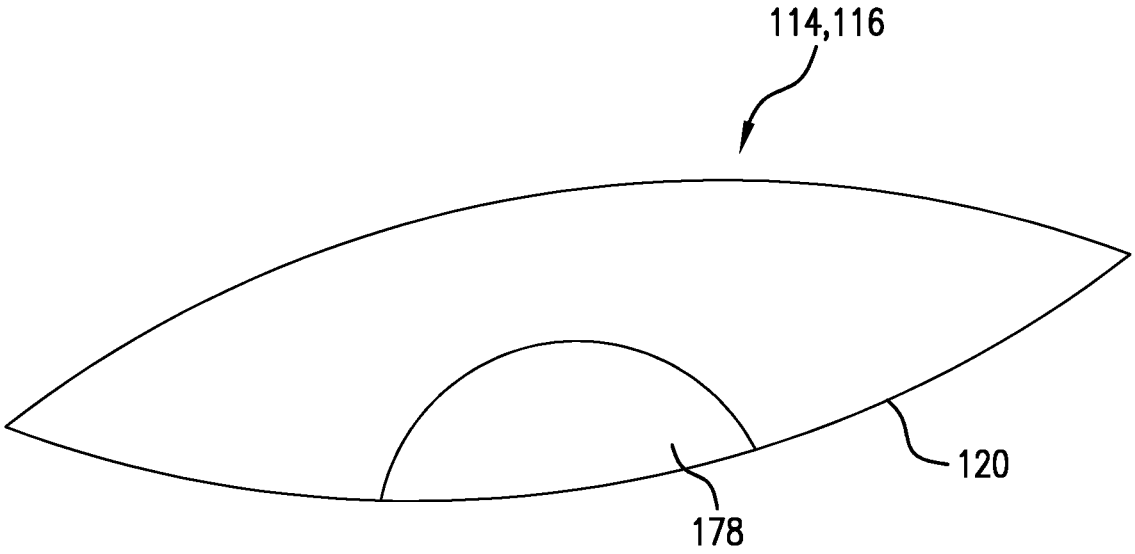
FIG. 24 shows a partial view of a shoe according to one embodiment of the invention.

In another embodiment of the invention, as shown in FIG. 24, a suspension element 114, 116 includes a suspension bumper 178. The suspension bumper 178 protrudes from at least a portion of the lower suspension arm 120 and is preferably made from EVA foam. The bumper 178 limits suspension compression and possible damage from heavier wearers landing on curbs and other hard-edged surfaces. The suspension bumper 178 may include a single protrusion that extends through a portion, or all of the suspension element. The suspension bumper 178 may also be a small, isolated protrusion in a center of the suspension element, or the suspension element may include multiple suspension bumpers displaced throughout various portions of the hollow interior of the suspension element. In any case, the suspension bumper is preferably round, as shown in FIG. 24, although other desirable shapes and/or sizes may be used as well.

Figure 25:
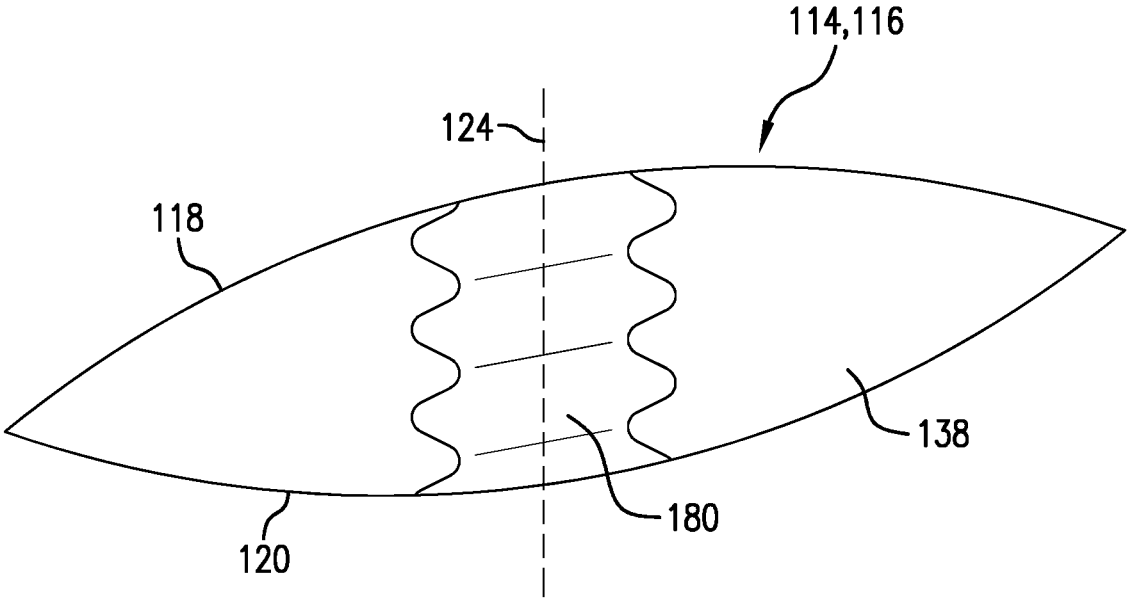
FIG. 25 shows a partial view of a shoe according to one embodiment of the invention.

In another embodiment of the invention, as shown in FIG. 25, a suspension element 114, 116 includes a suspension booster 180. The suspension booster 180 is aligned with the center of compression 124 of the suspension element, attached from a portion of the upper suspension arm 118 to a portion of the lower suspension arm 120. The booster 180 preferably extends through a center of the hollow interior 138 of the suspension element, appearing essentially perpendicular to the ground, although a variation of positions and angles of orientation may be used as well.

The suspension booster 180 is preferably an EVA or urethane component provided to increase load capacity and/or ride quality of the shoe. The suspension booster can firm up the respective suspension element for heavier runners or those needing firmer suspension on the medial side of the shoe to reduce pronation, for example.

The suspension booster may be inserted to fit into a desired suspension element or may be affixed with integrated hangers or self-stick into the interior of the suspension element. Additionally, suspension boosters with varying spring rates and/or other properties may be provided and inserted into medial and lateral sides of the suspension elements, adjusted to customize the shoe for an individual wearer.

Figure 26A:
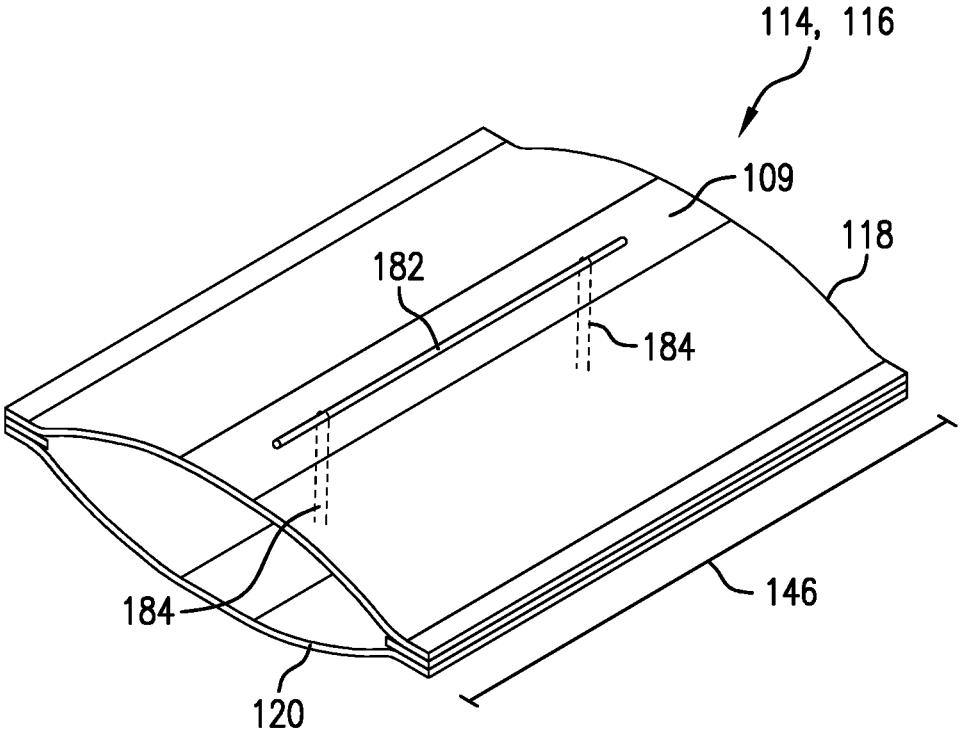
FIG. 26A shows a partial perspective view of a shoe according to one embodiment of the invention.
Figure 26B:
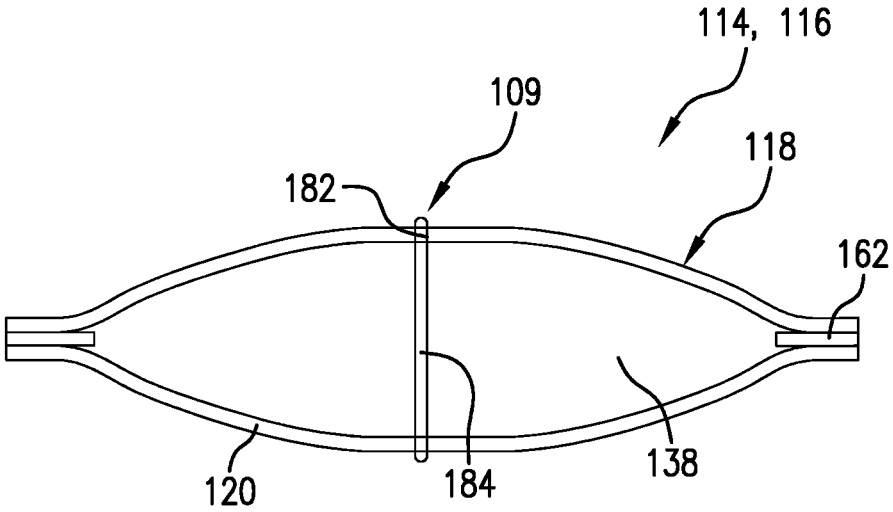
FIG. 26B shows a partial side view of a show according to the embodiment shown in FIG. 26A.

In another embodiment of the invention, as shown in FIGS. 26A and 26B, a suspension element 114, 116 includes a retaining rod 182 that extends through the center 109 of a portion of the lateral width 146 of the upper suspension arm 118. The retaining rod 182 includes a plurality of links 184 that extend from the retaining rod 182, perpendicular to the retaining rod, through the hollow interior 138 of the suspension element. The links 184 preferably include a stainless steel cable to pull the upper and lower arms of the suspension element towards each other.

The retaining rod and corresponding links can be added to one or more suspension elements of a shoe to pre-load a static spring rate into the shoe. For example, in one embodiment of the shoe without a retaining rod and links, a suspension element with a height of 25 mm includes a spring rate of 640 lb/in. This suspension element could be modified to 28 mm in height for a spring rate of 25.2 lb/mm Using a retaining rod and links to reduce the height of the suspension element back to 25 mm, the resulting suspension element still maintains 640 lb/in in spring rate, while also having 25.2 lb/mm by 3 mm in height reduction, resulting in 75.6 lb of preload. This results in a stride with higher energy and a greater "snap" when pressure is applied and let off of the suspension elements. In some embodiments the links may be asymmetrically adjusted to allow for tuning of gait stability and to best support an individual wearer's anatomical characteristics.

Figure 27:
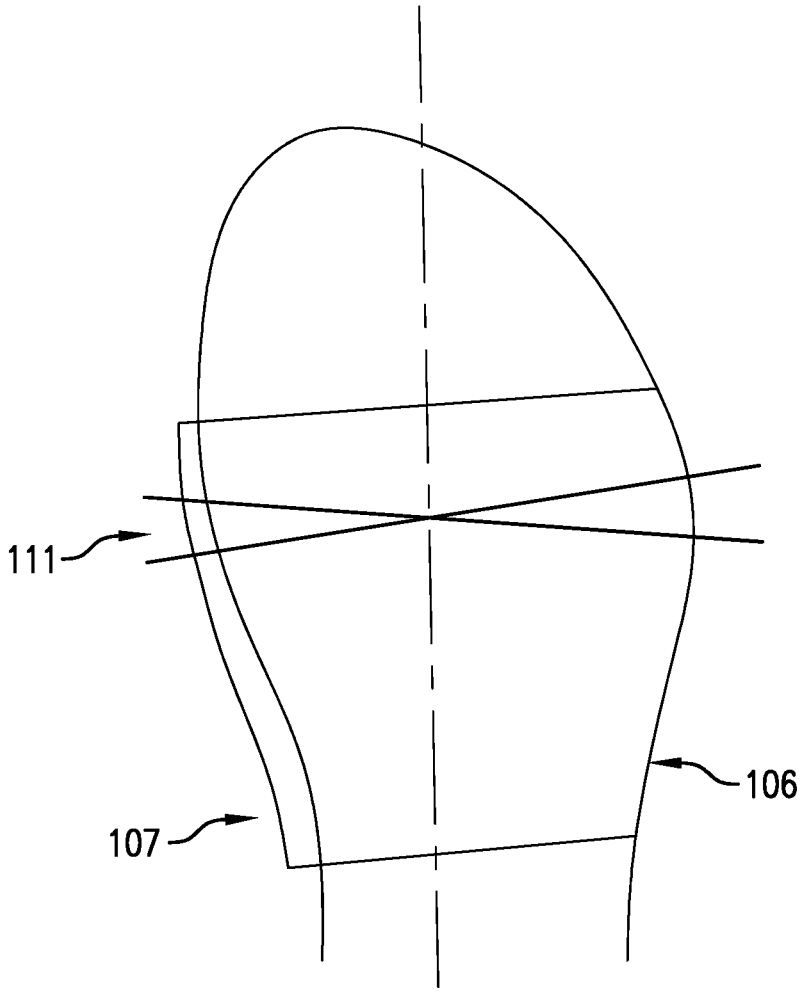
FIG. 27 shows a partial view of a shoe according to one embodiment of the invention.

Another embodiment of the invention includes modifications to a hinge operation angle with the forefoot suspension element. FIG. 27 shows a schematic representation of a hinge activation angle 111, pronation, neutral orientation, and medial extension 107 achieved with a forefoot suspension element in the forward region 106 of the shoe. By varying this identified hinge operation angle the shoe can compensate, and correct, for overpronation by steering the forefoot into correct alignment with the forefoot suspension element.

Figure 28A:
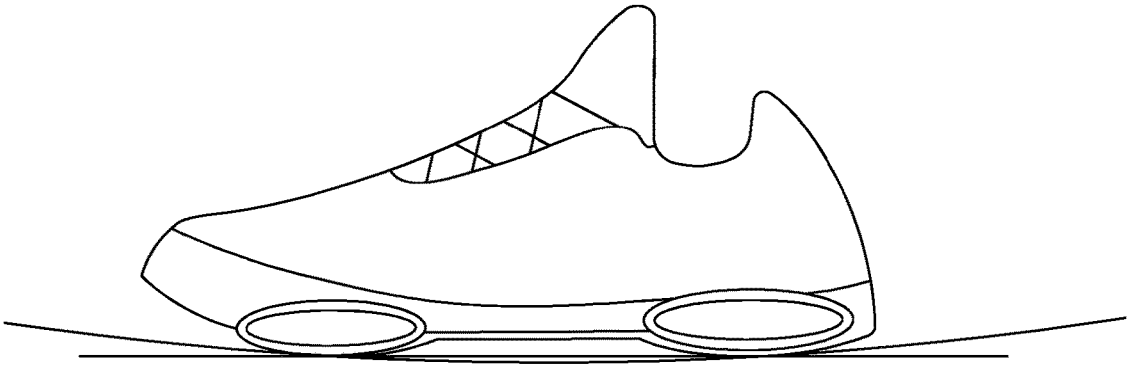
Prior Art FIG.28A
FIG. 28A shows a side view of a shoe according to the prior art.

The various properties of the suspension elements of the present invention as discussed above, contribute to a variety of benefits over the prior art. FIG. 28A shoes a side view of a shoe according to the prior art. As shown, this shoe has almost no angle of incidence—spacing between the heel and/or toe portions of the shoe and the ground. A forward suspension element according to this shoe includes a length of 65 mm by a height of 9 mm, with 4 mm of compressible travel. A rear suspension element according to this shoe includes a length of 65 mm by a height of 14 mm, with 7 mm of compressible travel. As further discussed in the '351 patent, such suspension elements were created with little awareness of the need for torsional lateral stability, and they also reduced total energy storage potential by a significant degree.

As such, the present invention provides improved suspension elements with increased energy storage by modifying the sizes of the suspension elements, as well as the materials and construction. Suspension elements include a radius on a bottom of the shoe, known as a "rocker". In the prior art, the rocker radius is approximately 35 inches. In the present invention, the shoe preferably includes a rocker radius of approximately 20 inches. The lower rocker radius benefits smoothness of energy transfer of the shoe during a stride by accommodating better leg movement geometry compared to the prior art.

Figure 28B:
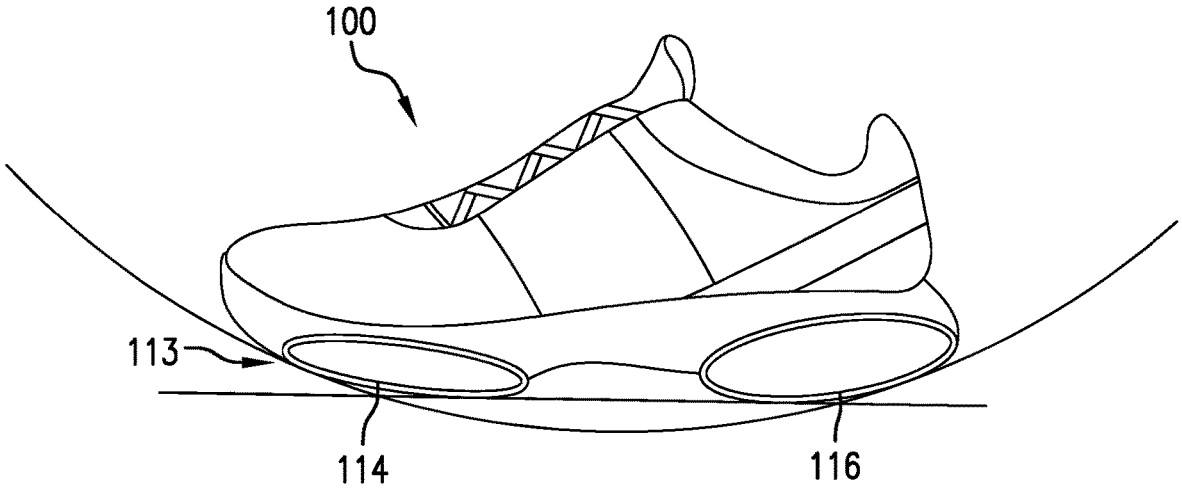
FIG. 28B shows a side view of a shoe according to one embodiment of the invention.

FIG. 28B shows a side view of a shoe according to an embodiment of the present invention. By increasing the sizes and lateral stability of suspension elements, the shoe of the present invention includes a much smaller radius rocker contour with a much larger angle of incidence 113 (preferably 6° or more) in comparison with the prior art.

The prior art (such as the shoe shown in FIG. 28A and the '351 patent) includes a heel suspension element that is parallel to the ground. The heel suspension element of the present invention is inclined to properly initiate ground contact during a running or walking stride. The angle of heel inclination is preferably 6° as shown, although other angles may be desirable as well.

A forward suspension element 114 according to the shoe shown in FIG. 28B includes a length of 60-100 mm or more, preferably 95 mm, by a height of 7-20 mm or more, preferably 16-18 mm. When engaging the forward suspension element, the height includes a compressible travel of 5-10 mm or more, preferably 8 mm of travel.

A rear suspension element 116 according to this shoe includes a length of 60-95 mm or more, preferably 90 mm, by a height of 12-30 mm or more, preferably 25 mm. When engaging the rear suspension element, the height includes a compressible travel of 8-15 mm or more, preferably 13 mm of travel.

Figure 29:
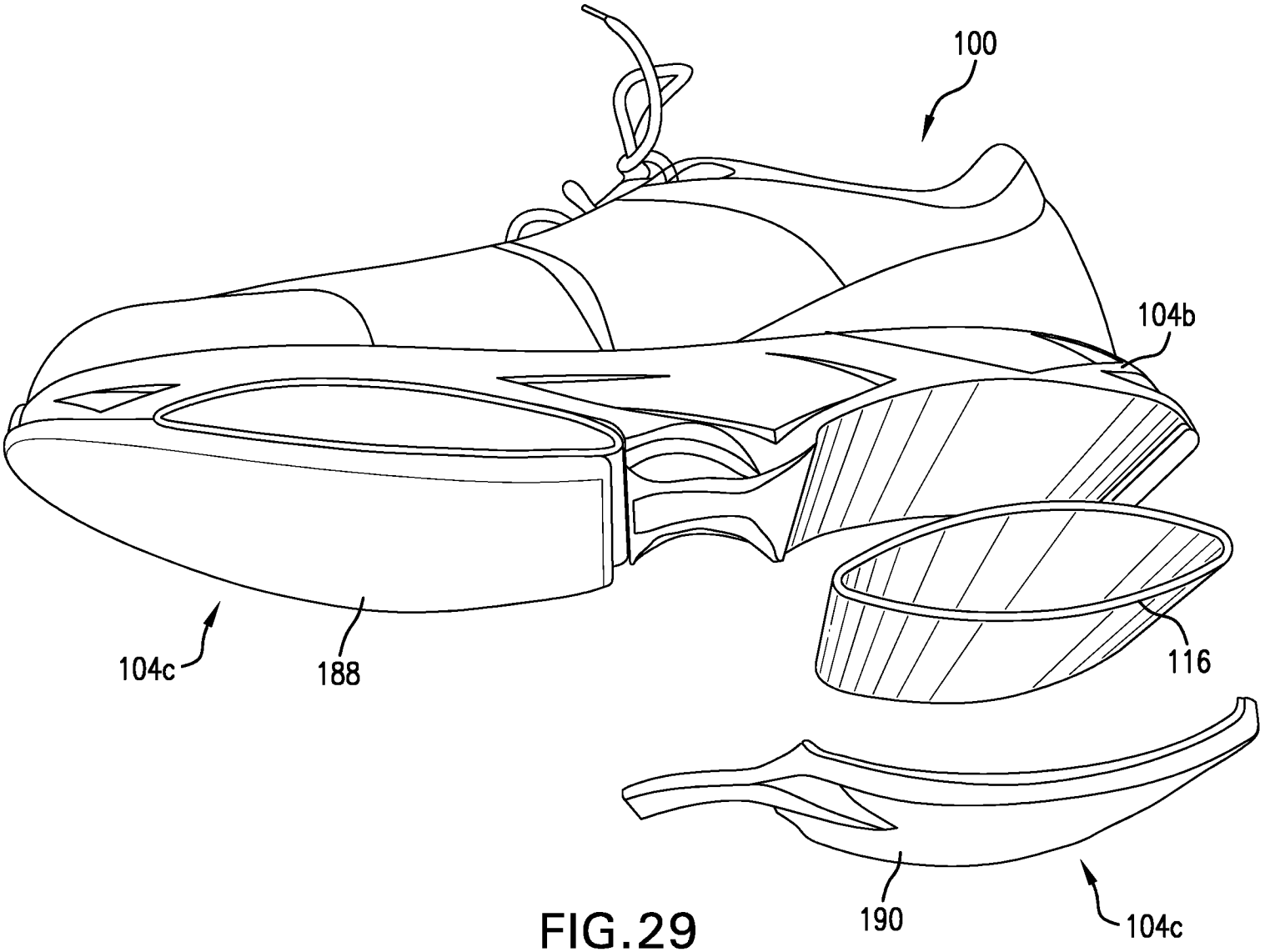
FIG. 29 shows a perspective side view of a shoe according to one embodiment of the invention.

FIG. 29 shows an embodiment of the present invention where the shoe 100 includes replacement suspension elements. The shoe may include a replaceable rear suspension element 116 by including a two-piece outsole 104*c*. The outsole 104*c* includes a first piece 188 and a second piece 190. The second piece 190 of the outsole occurs below the rear suspension element 116. If/when the rear suspension element 116 needs to be replaced, the second piece 190 of the outsole 104*c* can be removed from the shoe, where the suspension element can then be removed, and replaced with a new suspension element.

To separate and replace a suspension element and/or a portion of the outsole, the outsole may include a fastening material such as a 3M DUAL LOCK® fastener or various hook and loop closures. Other types of fasteners could be used as well such as electrically or chemically releasable adhesives.

Replacement of one or more suspension elements of a shoe according to the present invention may be desired for a variety of reasons. A wearer may desire to change a suspension element to adjust the loading rate of the stock or default suspension element. For example, a heavier wearer (with a weight of 200 lb or greater), may desire to change a "standard rate" suspension element with a "heavy duty" suspension element. This would allow the wearer an ability to tune the shoe for their weight or carrying choice (such as if a wearer was carrying a backpack or other heavy item).

Further suspension element modifications may include different versions tuned to minimize pronation or supination, or may include versions tuned to have greater overall stability compared with standard weight and/or stability suspension. Worn suspension elements or outsole pieces can be replaced with new ones, and outsole pieces can be traded for outsole pieces suited to different terrain (such as a road tread outsole versus a trail tread or winter outsole).

The shoe of the present invention facilitates and optimizes for an entire chain of events to happen during a walk or run stride—from a higher amount of energy storage during heel entry compared to the prior art, to properly timed transfer of that energy during a mid-foot transition, rolling from mid foot to toe-off at completion of the stride.

Additional factors that may be incorporated into the subject shoe include precision-measured last locating of forefoot metatarsals and heel calcaneus, a hinge position relative to metatarsals and a suspension element, timing of heel entry, midfoot, hinge, and forefoot to toe-off relative to energy transfer, a rearward set of heel angles of inclination, as well as modifying forefoot length, width, height, and other mechanics.

The invention illustratively disclosed herein suitably may be practiced in the absence of any element, part, step, component, or ingredient which is not specifically disclosed herein. While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A shoe comprising:

an upper and a sole comprising a forward region with a forward center of loading and a rear region with a rear center of loading;

wherein the sole comprises:

an insole;

a midsole;

an outsole;

two integrated suspension elements, wherein the integrated suspension elements comprise an upper suspension arm and a lower suspension arm that are joined at respective ends;

at least one joint element, wherein the at least one joint element is configured to secure first and second ends of the upper suspension arm with respective first and second ends of the lower suspension arm;

wherein the integrated suspension elements are disposed between at least a portion of the midsole and the outsole, the integrated suspension elements each having a center of compression, wherein each center of compression is generally aligned with the forward center of loading and the rear center of loading, respectively, the integrated suspension elements extending substantially laterally across a width of the midsole and the outsole; and wherein the midsole and the outsole comprise different layers and materials proximate the integrated suspension elements.

2. The shoe of claim 1, wherein the two integrated suspension elements comprise a forefoot suspension element and a heel suspension element.

3. The shoe of claim 2 wherein the forefoot suspension element comprises a length that is greater than a length of the heel suspension element.

4. The shoe of claim 2 wherein the heel suspension element comprises a height that is greater than a height of the forefoot suspension element.

5. The shoe of claim 1 wherein the material of the midsole surrounds at least a portion of the upper suspension arm.

6. The shoe of claim 1 wherein the material of the outsole surrounds at least a portion of the lower suspension arm.

7. The shoe of claim 1 wherein at least one integrated suspension element comprises two intersecting arcs defined by the upper suspension arm and the lower suspension arm forming a mandorla, defining a hollow suspension region therebetween.

8. The shoe of claim 1 wherein the joint element comprises at least one elastomer, polymer, or mechanical hinge.

9. The shoe of claim 1 wherein at least one integrated suspension element comprises a carbon suspension core, and variably-arranged polypropylene fibers, wherein the variably-arranged polypropylene fibers are configured to overlay the carbon suspension core.

10. The shoe of claim 1, further comprising at least two integrated suspension elements: a forward integrated suspension element disposed below the forward region of the upper and the sole, and a rear integrated suspension element disposed below the rear region of the upper and the sole, wherein each of the forward integrated suspension element and the rear integrated suspension element comprise a hollow, mandorla-shape defined by an upper suspension arm and a lower suspension arm joined by at least one joint configured to join the upper suspension arm and the lower suspension arm at respective ends of the upper suspension arm and the lower suspension arm.

11. The shoe of claim 10 wherein the forward integrated suspension element comprises a center of compression generally aligned with the forward center of loading, the forward integrated suspension element comprising:

a length of 60-100 mm defined by a distance between ends of the upper suspension arm and/or ends of the lower suspension arm; and a height of 7-20 mm defined by a distance between a center of the upper suspension arm and a center of the lower suspension arm.

12. The shoe of claim 10 wherein the midsole comprises an openable cavity extending a lateral width of the forward integrated suspension element disposed between a portion of the midsole and a portion of the upper suspension arm of the forward integrated suspension element, wherein the openable cavity extends longitudinally from an end of the upper suspension arm of the forward integrated suspension element, to another point along a length of the upper suspension arm.

13. The shoe of claim 12 wherein the midsole further comprises a fabric border extending along a perimeter of the openable cavity, wherein the fabric border abuts a portion of midsole and the upper suspension arm of the forward integrated suspension element.

14. The shoe of claim 10 wherein the rear integrated suspension element comprises a compressible layer disposed between a portion of the outsole and the lower suspension arm of the rear integrated suspension element, wherein the compressible layer extends along a length of the lower suspension arm.

15. The shoe of claim 10 wherein the rear integrated suspension element comprises a center of compression generally aligned with the rear center of loading, the rear integrated suspension element comprising:

a length of 60-95 mm defined by a distance between ends of the upper suspension arm and/or ends of the lower suspension arm; and a height of 12-30 mm defined by a distance between a center of the upper suspension arm and a center of the lower suspension arm.

16. The shoe of claim 10 wherein the sole comprises at least one cavity disposed across a portion of a lateral width of the rear integrated suspension element disposed between a portion of the sole and a portion of the upper suspension arm of the rear integrated suspension element.

17. The shoe of claim 16 wherein the sole comprises a plurality of cavities disposed generally equidistant across the lateral width of the midsole disposed between a portion of the sole and a portion of the upper suspension arm of the rear integrated suspension element.

18. A shoe comprising:

an upper including a forward region with a forward center of loading and a rear region with a rear center of loading;

an insole;

a midsole comprising a plurality of layers and materials and further comprising at least one convex suspension arm integrated with a portion of the midsole, wherein the at least one convex suspension arm comprises a composite material having a greater resistance than the plurality of layers and materials of the midsole;

an outsole comprising a plurality of layers and materials and further comprising at least one concave suspension arm integrated with a portion of the outsole, wherein the at least one concave suspension arm comprises a composite material having a greater resistance than the plurality of layers and materials of the outsole;

wherein a first end of the at least one convex suspension arm is joined with a first end of the at least one concave suspension arm, and wherein a second end of the at least one convex suspension arm is joined with a second end of the at least one concave suspension arm, wherein the at least one convex suspension arm and the at least one concave suspension arm are configured to form a mandorla-shaped suspension element integrated between the midsole and the outsole;

at least one joint element, wherein the at least one joint element is configured to secure the first and second ends of the at least one convex suspension arm with the first and second ends of the at least one concave suspension arm; and a center of compression defined at a center of the mandorla-shaped suspension element, wherein the center of compression is generally aligned with at least one of the forward center of loading and the rear center of loading, the mandorla-shaped suspension element extending substantially laterally across a width of the midsole and the outsole.

19. The shoe of claim 18 wherein the at least one joint comprises an elastomer disposed therebetween at least one pair of the first ends and the second ends.

20. The shoe of claim 18 wherein the at least one concave suspension arm comprises a stiffer material than the at least one convex suspension arm.

21. The shoe of claim 18 wherein the mandorla-shaped suspension element comprises a plurality of carbon fibers, wherein at least 20% of the plurality of carbon fibers are oriented laterally across a surface area of the mandorla-shaped suspension element, and wherein no more than 80% of the plurality of carbon fibers are oriented longitudinally across the surface are of the mandorla-shaped suspension element.

22. The shoe of claim 21, wherein up to 100% of the plurality of carbon fibers are bias-oriented against one another, wherein the plurality of fibers are biased at an angle of at least 20 degrees.

23. The shoe of claim 18 wherein the at least one concave suspension arm comprises a suspension bumper aligned with the center of compression, wherein the suspension bumper protrudes into a hollow interior of the mandorla-shaped suspension element.

24. The shoe of claim 18 wherein the at least one joint element is positioned between opposing parallel portions of the first and second ends of the convex suspension arm and the first and second ends of the concave suspension arm.

25. A shoe comprising:

an upper including a forward region with a forward center of loading and a rear region with a rear center of loading;

an insole comprising a high density sock layer;

a midsole comprising a plurality of layers and materials;

an outsole comprising rubber;

a first mandorla-shaped suspension element comprising an upper suspension arm and a lower suspension arm;

wherein the first mandorla-shaped suspension element is disposed between at least a portion of the midsole and the outsole, the first mandorla-shaped suspension element having a center of compression, wherein the center of compression is generally aligned with the forward center of loading, the first mandorla-shaped suspension element extending substantially laterally across a width of the midsole and the outsole;

a second mandorla-shaped suspension element comprising an upper suspension arm and a lower suspension arm; and wherein the second mandorla-shaped suspension element is disposed between at least a portion of the midsole and the outsole, the second mandorla-shaped suspension element having a center of compression, wherein the center of compression is generally aligned with the rear center of loading, the second mandorla-shaped suspension element extending substantially laterally across a width of the midsole and the outsole; and at least one joint element, wherein the at least one joint element is configured to secure the first and second ends of each of the upper suspension arms with the first and second ends of each of the lower suspension arms.

26. The shoe of claim 25 wherein the first mandorla-shaped suspension element comprises a height from a center of the upper suspension arm and a center of the lower suspension arm of 7-20 mm, wherein the height comprises a compressible travel of 5-10 mm in a heightwise direction.

27. The shoe of claim 25 wherein the second mandorla-shaped suspension element comprises a height from a center of the upper suspension arm and a center of the lower suspension arm of 12-30 mm, wherein the height comprises a compressible travel of 8-15 mm in a heightwise direction.

28. The shoe of claim 25 wherein the plurality of layers of the midsole comprise a thickness of 4-10 mm at at least one of the centers of compression.

29. The shoe of claim 1 wherein the at least one joint element is positioned between opposing flat portions of the first and second ends of the upper suspension arm and the first and second ends of the lower suspension arm.

30. The shoe of claim 25 wherein the at least one joint element is positioned between opposing flat and parallel portions of each of the first and second ends of the upper suspension arm and the first and second ends of the lower suspension arm.

* * * * *